US007413490B2

(12) United States Patent
Tawa et al.

(10) Patent No.: US 7,413,490 B2
(45) **Date of Patent: *Aug. 19, 2008**

(54) OUTBOARD MOTOR STEERING SYSTEM

(75) Inventors: Hiroki Tawa, Saitama (JP); Makoto Yazaki, Saitama (JP); Taiichi Otobe, Saitama (JP); Takao Kashima, Saitama (JP); Hideaki Takada, Saitama (JP); Hiroshi Mizuguchi, Saitama (JP)

(73) Assignee: Honda Motor Co., LTD., Tokyo (JP)

( * ) Notice: Subject to any disclaimer, the term of this patent is extended or adjusted under 35 U.S.C. 154(b) by 335 days.

This patent is subject to a terminal disclaimer.

(21) Appl. No.: 11/153,070

(22) Filed: Jun. 15, 2005

(65) Prior Publication Data

US 2005/0282448 A1 Dec. 22, 2005

(30) Foreign Application Priority Data

Jun. 16, 2004 (JP) ..... 2004-178203
Jun. 18, 2004 (JP) ..... 2004-181285
Jun. 18, 2004 (JP) ..... 2004-181286

(51) Int. Cl.
*B63H 5/125* (2006.01)

(52) U.S. Cl. ..... 440/61 A; 440/61 S

(58) Field of Classification Search ..... 440/61 R, 440/61 S, 61 A, 61 T, 61 D, 61 G; 60/486
See application file for complete search history.

(56) References Cited

U.S. PATENT DOCUMENTS

| | | | | |
|---|---|---|---|---|
| 4,836,810 | A * | 6/1989 | Entringer | 440/61 R |
| 5,149,285 | A * | 9/1992 | Kinoshita | 440/61 R |
| 5,327,986 | A * | 7/1994 | Saita | 180/446 |
| 5,340,341 | A * | 8/1994 | Yoshimura | 440/61 R |
| 5,505,641 | A * | 4/1996 | Onoue | 440/61 R |
| 2003/0186600 | A1 * | 10/2003 | Ozawa | 440/61 S |
| 2005/0072145 | A1 * | 4/2005 | Jervis | 60/430 |

FOREIGN PATENT DOCUMENTS

| | | |
|---|---|---|
| JP | 62-125996 | 6/1987 |
| JP | 07-228296 | 8/1995 |

* cited by examiner

*Primary Examiner*—Ed Swinehart
(74) *Attorney, Agent, or Firm*—Carrier, Blackma & Associates, P.C.; William D. Blackman; Joseph P. Carrier

(57) ABSTRACT

An outboard motor steering system includes a hydraulic fluid supply mechanism connected to the steering hydraulic cylinder to supply hydraulic fluid thereto disposed in a space formed between the stern brackets and the swivel case. In other words, since the hydraulic fluid supply mechanism is incorporated into the outboard motor as a unit, the structure can be made simpler than that of the related art and the number of parts in the entire system can be reduced and moreover the work of installation into the boat's hull can be simplified. Also, operating efficiency is improved for an electric motor serving as the source of driving force for a hydraulic pump that supplies hydraulic fluid to the hydraulic cylinder used for steering, and power consumption is reduced.

6 Claims, 17 Drawing Sheets

OUTBOARD MOTOR STEERING SYSTEM

CROSS-REFERENCE TO RELATED APPLICATION

This application claims priority under 35 U.S.C. §119 from each of the following priority documents: Japanese Patent Application No. 2004-178203. filed on 16 Jun. 2004; Japanese Patent Application No. 2004-181285, filed on 18 Jun. 2004; and Japanese Patent Application No. 2004-181286. filed on 18 Jun. 2004. The complete disclosure and drawings of each of the above-referenced priority documents is hereby incorporated by reference.

BACKGROUND OF THE INVENTION

1. Field of the Invention

This invention relates to an outboard motor steering system and more specifically to an outboard motor steering system wherein the steering mechanism is driven by an actuator.

2. Description of the Related Art

The source of motive power for conventional outboard motor steering mechanisms including, for example, the tiller handle type, where a tiller handle mounted to the outboard motor is steered by an operator's hand, and the remote control type, where the steering mechanism is controlled remotely via a push-pull cable, is generally human power.

However, the steering load is typically heavy in such systems that utilize human power, so the burden on the operator is large. To solve this problem, for example, with the prior art recited in Japanese Laid-Open Patent Application No. Sho 62(1987)-125996, FIG. 2, etc., a hydraulic actuator (specifically a hydraulic cylinder) is connected to the steering mechanism (tiller handle) of the outboard motor via an arm and the like, thus reducing the steering load by actuating the hydraulic cylinder in a manner corresponding to the steering input of the operator. A pump that supplies hydraulic fluid to the hydraulic cylinder is connected to a steering wheel, and the hydraulic cylinder and pump are connected via hydraulic lines disposed within the hull (boat).

In addition, prior art that allows the tilt and trim angles of the outboard motor to be adjustable with a hydraulic actuator has also been proposed by, for example, Japanese Laid-Open Patent Application No. Hei 7(1995)-228296, FIGS. 2, 3 etc.

However, with the prior art recited in '996 mentioned above, where the mechanism for supplying hydraulic fluid to the cylinder (i.e., pumps and hydraulic paths) is disposed in the boat, there are problems in that the structure becomes complex and the number of parts increases, and also the work of installing the system in the boat becomes complicated.

Further, when the steering angle of an outboard motor is adjusted with a hydraulic actuator, this requires a hydraulic fluid supply source (hydraulic pump and electric motor that drives the hydraulic pump) for supplying fluid to the actuator. However, the steering load of an outboard motor (specifically, the driving force of the hydraulic actuator required to adjust the steering angle) varies greatly depending on the type of boat, its speed, the wave conditions and the like. Accordingly, if the output torque of the electric motor that drives the hydraulic pump is inadequate, differences in the driven speed of the hydraulic actuator arise depending on fluctuations in load, so there is a risk of deterioration of the steering feel.

To solve this problem, the electric motor that drives the hydraulic pump is typically given sufficient output torque to be able to adequately handle the maximum hypothetical load so that stable steering can be achieved even should fluctuations in the steering load arise. However, with such a configuration, there is a problem in that torque that exceeds the output required for steering continues to be provided as output even at times of low loads, so the operating efficiency is poor and the power consumption is wasteful.

Furthermore, when the tilt and trim angles of an outboard motor are adjusted using a hydraulic actuator, a hydraulic fluid supply source for supplying fluid to this actuator is also required and the required capacity of this hydraulic fluid supply source to supply pressurized hydraulic fluid also varies greatly depending on the load factors of the type of boat, its speed and the wave conditions.

Specifically, there is a problem in that in order to stably adjust the tilt and trim angles with a hydraulic actuator, it is necessary to avoid increasing the power consumption by the hydraulic fluid supply source in the same manner as for steering.

SUMMARY OF THE INVENTION

An object of this invention is therefore to overcome these problems by providing an outboard motor steering system that has a simplified structure even though it uses a hydraulic actuator, and that also simplifies the work of installation in the hull (boat).

Another object of this invention is to provide an outboard motor steering system with improved operating efficiency for the electric motor serving as the source of driving force for the hydraulic pump that supplies hydraulic fluid to the hydraulic actuator used for steering, and also with reduced power consumption.

A further object of this invention is to provide an outboard motor steering system that reduces the power consumption of both the hydraulic fluid supply source that supplies hydraulic fluid to the hydraulic actuator for adjusting the steering angle and the hydraulic fluid supply source that supplies hydraulic fluid to the hydraulic actuator used for tilt and trim angle adjustment, and also allows the steering angle and tilt and trim angles to be adjusted stably even if fluctuations in load occur.

In order to achieve the first object, this invention provides, in a first aspect, a system for steering an outboard motor mounted on a stern of a boat through stern brackets and having a steering mechanism to steer the outboard motor relative to the boat, comprising: a swivel case attached to the stern brackets; a swivel shaft rotatably housed in the swivel case; a hydraulic actuator connected to the swivel shaft to rotate the swivel shaft; and a hydraulic fluid supply mechanism connected to the hydraulic actuator to supply hydraulic fluid to the hydraulic actuator; the hydraulic fluid supply mechanism being disposed in a space formed between the stern brackets and the swivel case.

In order to achieve the second object, the invention provides, in a second aspect, a system for steering an outboard motor, mounted on a stern of a boat through stern brackets, relative to the boat, comprising: a hydraulic actuator regulating a steering angle of the outboard motor relative to the boat; a hydraulic pump supplying hydraulic fluid to the hydraulic actuator; a plurality of electric motors driving the hydraulic pump; a steering load detector detecting steering load acting on the outboard motor; and a motor controller determining a number of the electric motors to be used to drive the hydraulic pump based on the detected steering load and controlling operation of the determined number of the electric motors.

In order to achieve the third object, this invention provides, in a third aspect, a system for steering an outboard motor, mounted on a stern of a boat through stern brackets, relative to the boat, comprising: a first hydraulic actuator adjusting a steering angle of the outboard motor relative to the boat; a first hydraulic fluid supply source supplying hydraulic fluid to the first hydraulic actuator; a second hydraulic actuator regulating a tilt/trim angle of the outboard motor relative to the boat; a second hydraulic fluid supply source supplying the hydraulic fluid to the second hydraulic actuator; and a fluid diverter diverting at least a part of the hydraulic fluid to be supplied to one of the first and second hydraulic actuators, to the other of the first and second hydraulic actuators.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

Here follows a description of preferred embodiments of the outboard motor steering system according to the present invention made with reference to the appended drawings.

Figure 1:
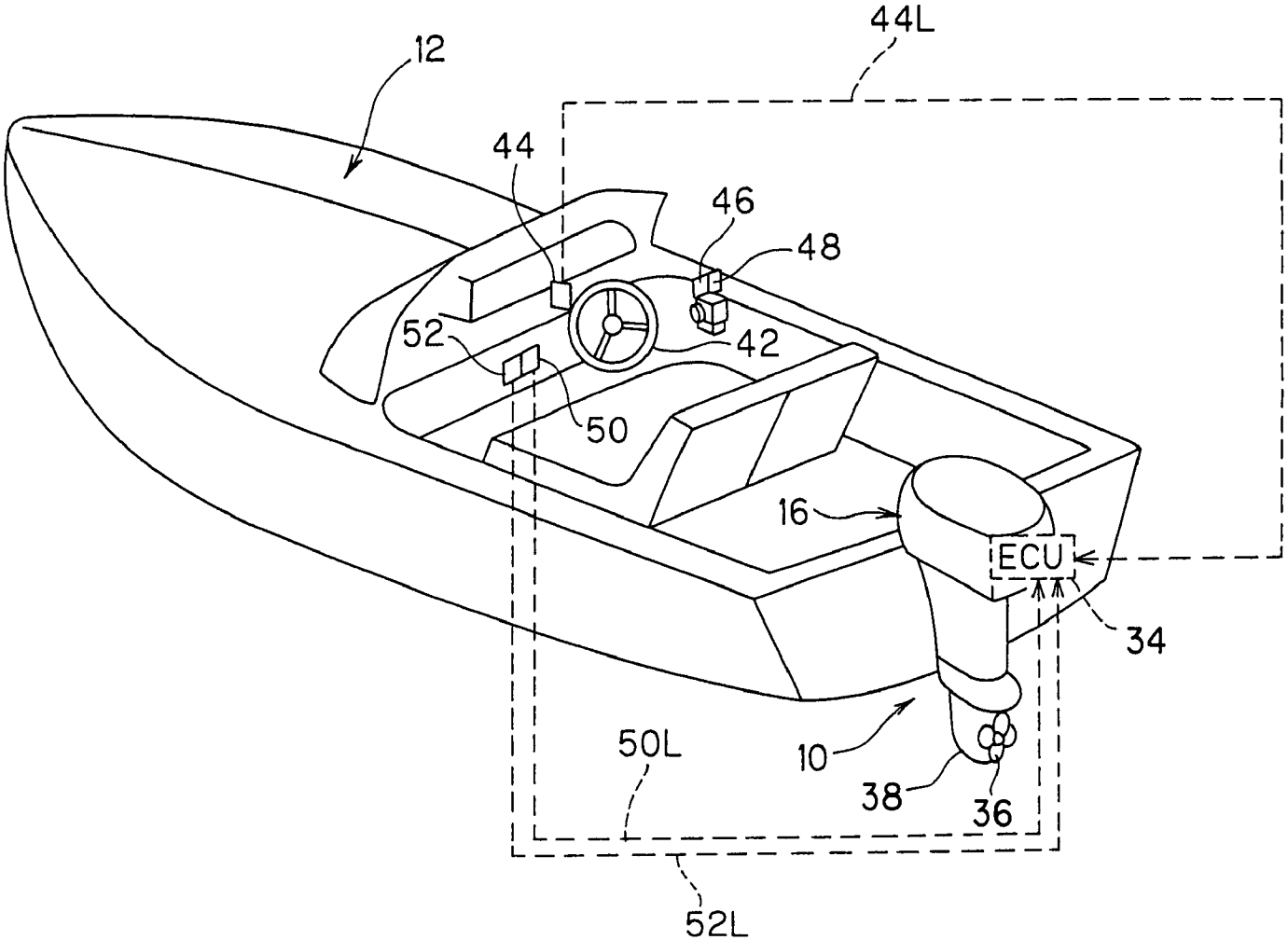
FIG. 1 is an overall schematic view of an outboard motor steering system according to a first embodiment of the invention.
Figure 2:
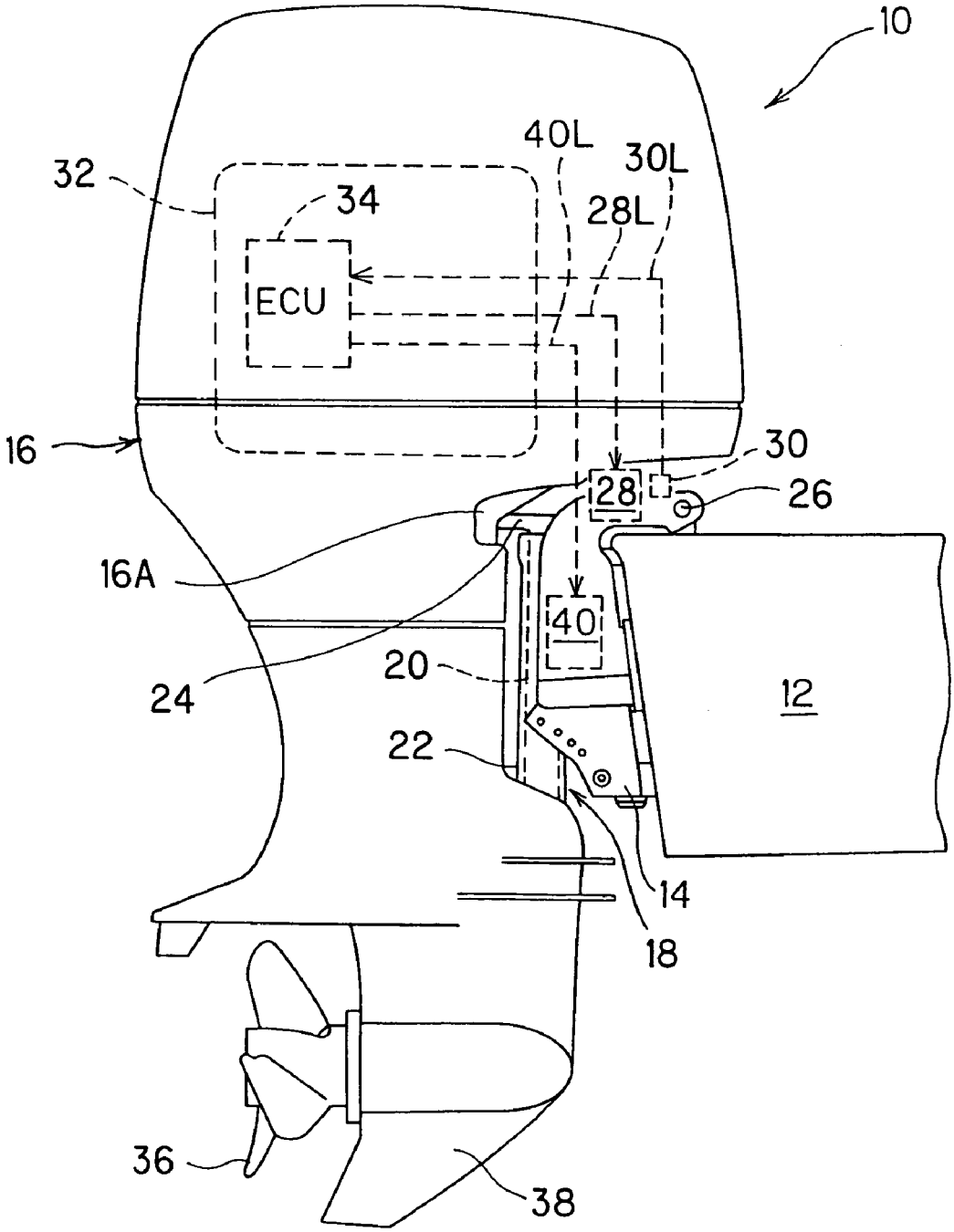
FIG. 2 is an explanatory partial side view of the system shown in FIG. 1.

FIG. 1 is an overall schematic view of an outboard motor steering system according to a first embodiment of the invention, with primary focus on the outboard motor. FIG. 2 is an explanatory partial side view of the system shown in FIG. 1.

In FIGS. 1 and 2, the symbol 10 indicates an outboard motor. As shown in FIG. 2, the outboard motor 10 comprises stern brackets 14 mounted on the stern of a hull (boat) 12 and an outboard motor main unit 16, where the outboard motor main unit 16 is connected to the stern brackets 14 via a steering mechanism 18 such that it can be steered.

The steering mechanism 18 comprises a swivel shaft 20 and a swivel case 22. The swivel shaft 20 is rotatably housed within the swivel case 22 and is also connected via a mount frame 24 with a fixed upper end to a frame 16A for the outboard motor main unit 16. In addition, the swivel case 22 is mounted to the stern brackets 14 via a tilting shaft 26. Thereby, with respect to the stern brackets 14, the outboard motor main unit 16 can be steered about the swivel shaft 20 as an axis of rotation and can also be tilted up and down about the tilting shaft 26 as another axis of rotation to adjust the trim up or down.

The steering mechanism 18 further comprises an actuator disposed at the upper end of the swivel case 22, or more specifically a reciprocating hydraulic cylinder (hereinafter called the "steering hydraulic cylinder") 28 and a hydraulic fluid supply mechanism (explained later) that supplies hydraulic fluid to the steering hydraulic cylinder 28.

In addition, a steering angle sensor 30 is disposed at the upper end of the outboard motor main unit 16 near the steering hydraulic cylinder 28. Specifically, the steering angle sensor 30 comprises a rotary encoder that generates output of a signal that depends on the angle of rotation of the swivel shaft 20 (or in other words, the steering angle of the outboard motor 10).

An internal combustion engine (hereinafter called simply the "engine") 32 is disposed in the upper portion of the outboard motor main unit 16. The engine 32 comprises a spark-ignition, in-line, four-cylinder, four-cycle gasoline engine with a displacement of 2,200 cc. An electronic control unit (ECU) 34 comprising a microcomputer is disposed near the engine 32.

On the other hand, a propeller 36 and a rudder 38 are provided on the lower part of the outboard motor main unit 16. The propeller 36 is rotated by the power of the engine 32 which is transmitted via a crankshaft, drive shaft, gear mechanism and shift mechanism (none of which is shown), thereby propelling the boat 12 in the forward or reverse direction.

In addition, a conventional power tilt/trim unit (tilt/trim angle adjusting mechanism) 40 for adjusting or regulating the tilt angle and trim angle of the outboard motor 10 (more precisely the outboard motor main unit 16) relative to the boat 12 is disposed near the stern brackets 14 and swivel shaft 20. The steering hydraulic cylinder 28 and power tilt/trim unit 40 are connected to the ECU 34 via signal lines 28L and 40L, respectively.

As shown in FIG. 1, a steering wheel 42 is disposed near the operator's seat of the boat 12. A steering wheel angle sensor 44 is disposed near the steering wheel 42. Specifically, the steering wheel angle sensor 44 comprises a rotary encoder that generates output of a signal that depends on the steering wheel angle (control input) of the steering wheel 42 input by the operator.

A shift lever 46 and throttle lever 48 are further disposed near the operator's seat. The shift lever 46 and throttle lever 48 are connected via push-pull cables to the shift mechanism and a metering valve (not shown), respectively, of the engine 32. The shift lever 46 may be operated to actuate the shift mechanism and thus change the direction of travel of the boat 12. In addition, the throttle lever 48 may be operated to open or close the metering valve and adjust the engine speed, thus adjusting the speed of the boat 12.

Moreover, a power tilt switch 50 that accepts input of commands to adjust the tilt angle of the outboard motor main unit 16 and a power trim switch 52 that accepts input of commands to adjust the trim angle are disposed near the operator's seat. Each of these switches 50 and 52 generates output of a signal that corresponds to the tilt up/down and trim up/down commands for the outboard motor main unit 16 as input by the operator.

The outputs of the steering angle sensor 30, steering wheel angle sensor 44, power tilt switch 50 and power trim switch 52 are sent to the ECU 34 via signal lines 30L, 44L, 50L and 52L, respectively. Based on these input values, the ECU 34 drives the steering hydraulic cylinder 28 to adjust or regulate the steering angle of the outboard motor 10 (more precisely the outboard motor main unit 16) relative to the boat 12 and also drives the power tilt/trim unit 40 to adjust or regulate the tilt angle and trim angles of the outboard motor main unit 16 relative to the boat 12. It should be noted that the tilt angle and trim angle are both values that indicate angles of rotation of the tilting shaft 26, so they shall hereinafter collectively be called the "tilt/trim angle" unless particular distinction is necessary.

Figure 3:
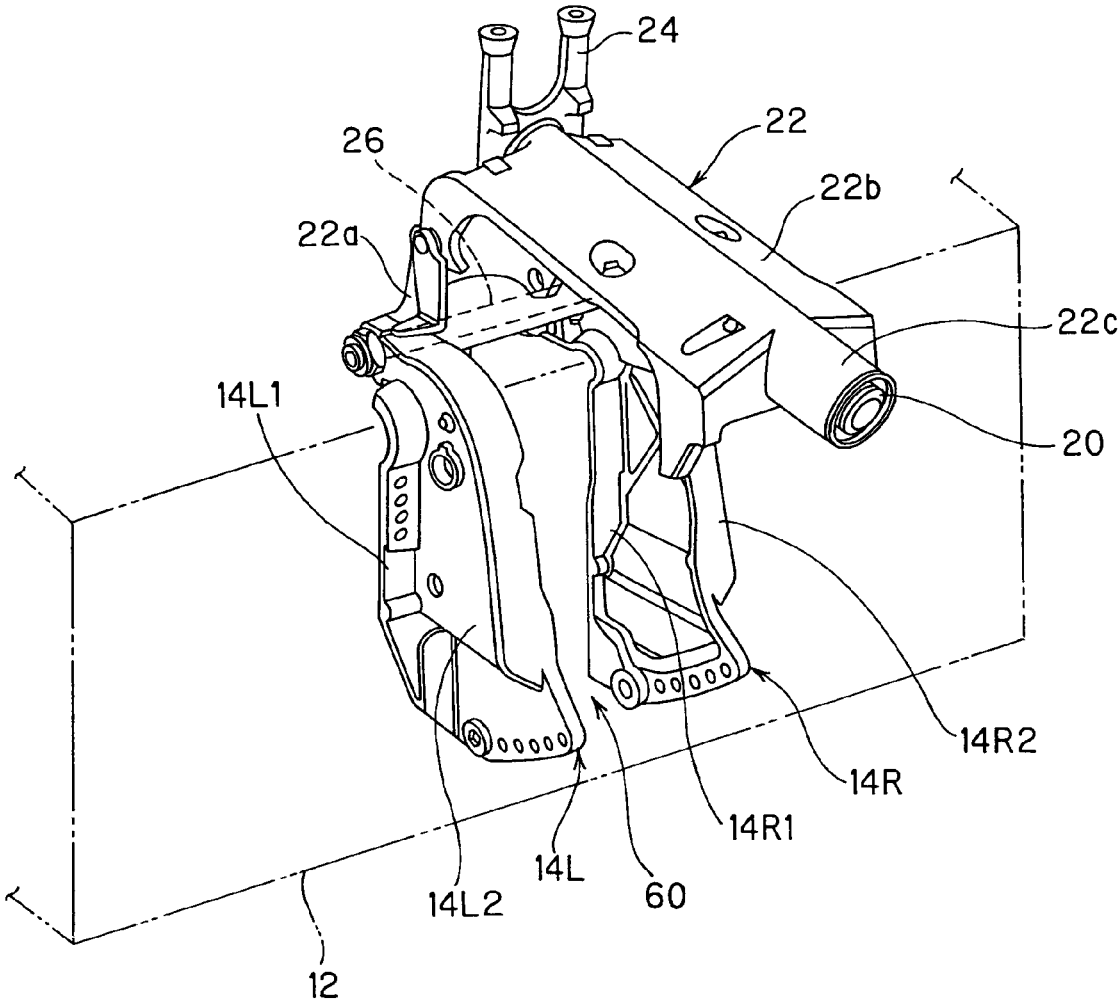
FIG. 3 is an enlarged perspective view of stern brackets and a swivel case shown in FIG. 2.

Here follows a detailed description of the stern brackets 14 and swivel case 22. FIG. 3 is an enlarged perspective view of the stern brackets 14 and swivel case 22. For ease of illustration, FIG. 3 shows the swivel case 22 tilted up and omits all members other than the stern brackets 14 and swivel case 22.

As shown in FIG. 3, the stern brackets 14 that substantially have left/right symmetry are affixed to the stern of the boat 12. Hereinafter, the stern bracket disposed to the left side when looking forward in the direction of travel of the boat 12 will be called the "left-side stern bracket" and given the symbol 14L. Similarly, the stern bracket disposed to the right side when looking forward in the direction of travel will be called the "right-side stern bracket" and given the symbol 14R.

The left-side and right-side stern brackets 14L and 14R respectively comprise seat portions 14L1 and 14R1 that are in contact with the stern of the boat 12 and wall portions 14L2 and 14R2 that extend rearward in the direction of travel from the seat portions 14L1 and 14R1. In addition, the upper ends of the left-side and right-side stern brackets 14L and 14R are formed into a hook shape and the aforementioned tilting shaft 26 is mounted near the front end of the portion given this hook shape (the front end in the direction of travel).

The swivel case 22 comprises a wall portion (the surface that becomes the upper surface when tilted down; indicated by the symbol 22*a*) that is connected to the tilting shaft 26 and another wall portion (the surface that, when tilted down, becomes substantially parallel to the plane of the stern of the boat 12 at a position separated therefrom by a predetermined distance; indicated by the symbol 22*b*), thereby substantially having an L shape when viewed from the side. In addition, a cylindrical portion 22*c* for housing the aforementioned swivel shaft 20 is formed in the wall portion 22*b*.

Figure 4:
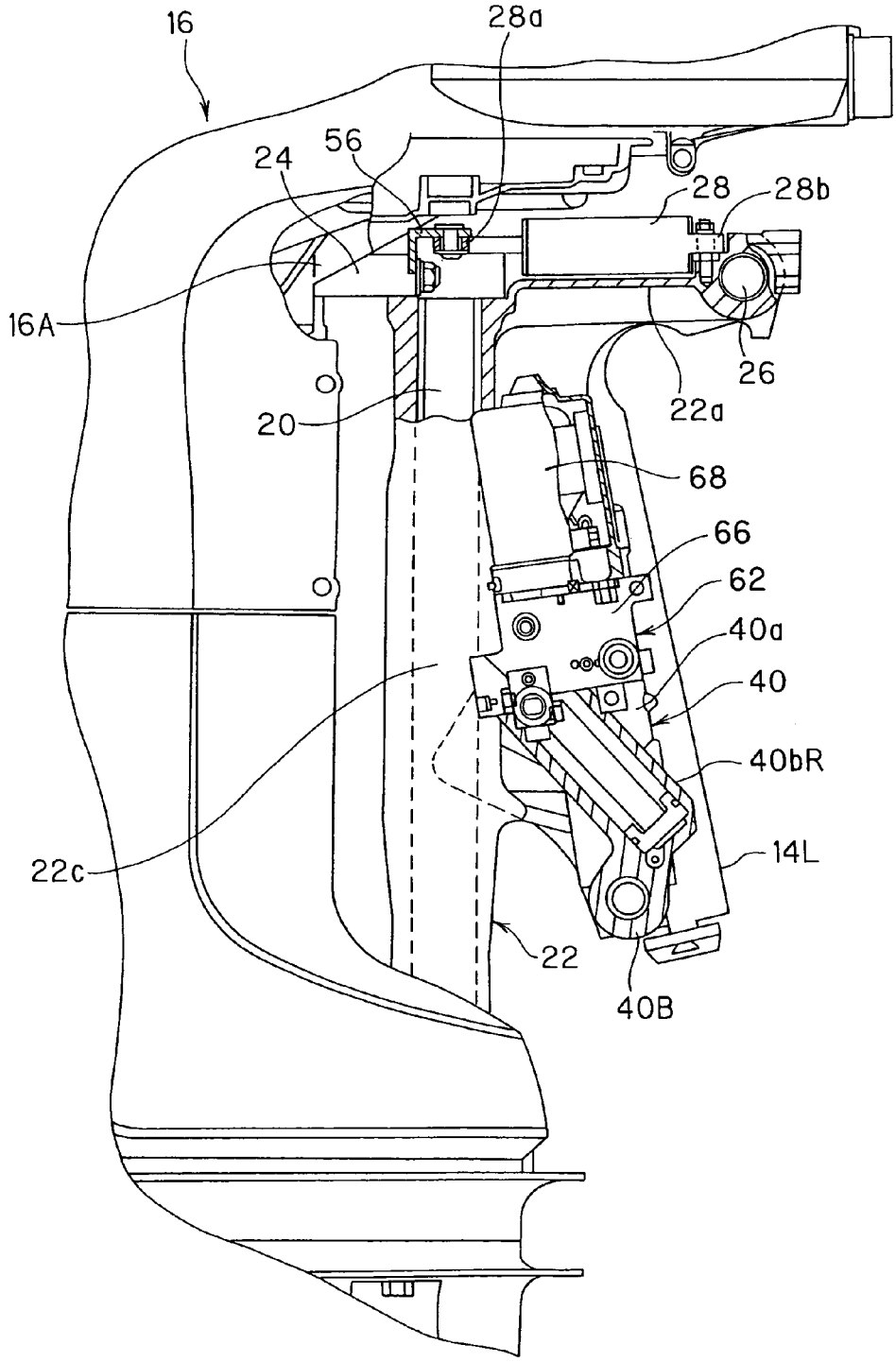
FIG. 4 is an enlarged partial cross section of the area around the stern brackets and swivel case shown in FIG. 2, etc., when viewed from the side.
Figure 5:
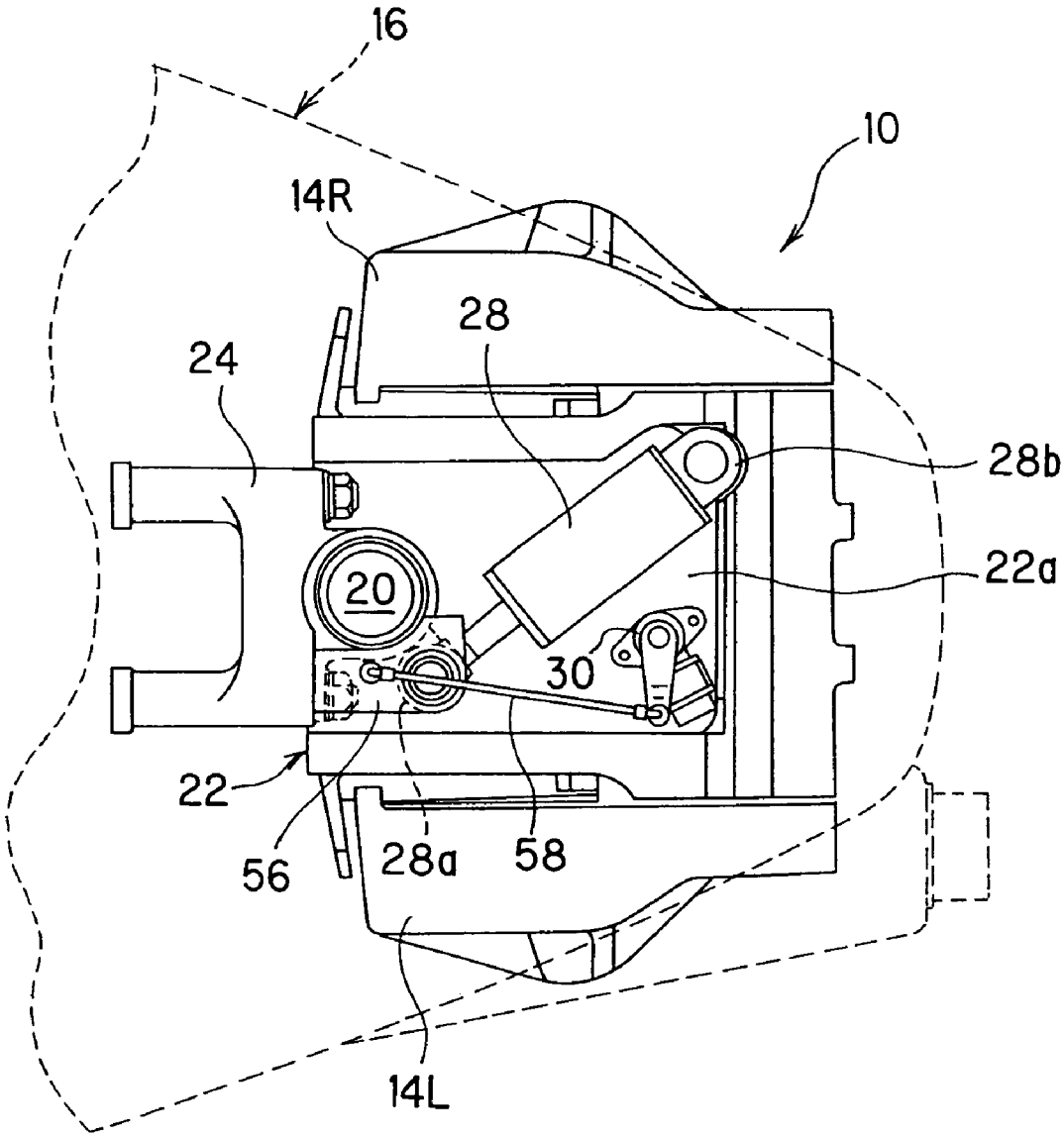
FIG. 5 is a schematic diagram of the swivel case shown in FIG. 2, etc., when viewed from above.

FIG. 4 is an enlarged partial cross section of the area around the stern brackets 14 and swivel case 22 when viewed from the side. In addition, FIG. 5 is a schematic diagram of the swivel case 22 when viewed from above. In FIG. 4, the right-side stern bracket 14R is shown removed for ease of illustration.

As shown in FIG. 4 and FIG. 5, the steering hydraulic cylinder 28 is disposed above the swivel case 22, or specifically above the wall portion 22*a* serving as the upper surface of the swivel case 22.

A stay 56 is provided nearly directly above the swivel shaft 20 in the mount frame 24. The steering hydraulic cylinder 28 has its rod head 28*a* rotatably attached to the stay 56 and also its cylinder bottom 28*b* rotatably attached to the top of the wall portion 22*a*. Thereby, when the rod of the steering hydraulic cylinder 28 extends or retracts, the mount frame 24 and swivel shaft 20 rotate, thus causing the outboard motor main unit 16 to be steered to the left or right. As shown in FIG. 5, the aforementioned steering angle sensor 30 is disposed above the swivel case 22.

The steering angle sensor 30 is connected to the stay 56 via a sensor rod 58. Thus, the angle of rotation of the swivel shaft 20, namely the steering angle of the outboard motor 10, is transmitted via the mount frame 24, stay 56 and sensor rod 58 to the steering angle sensor 30 and detected.

Figure 6:
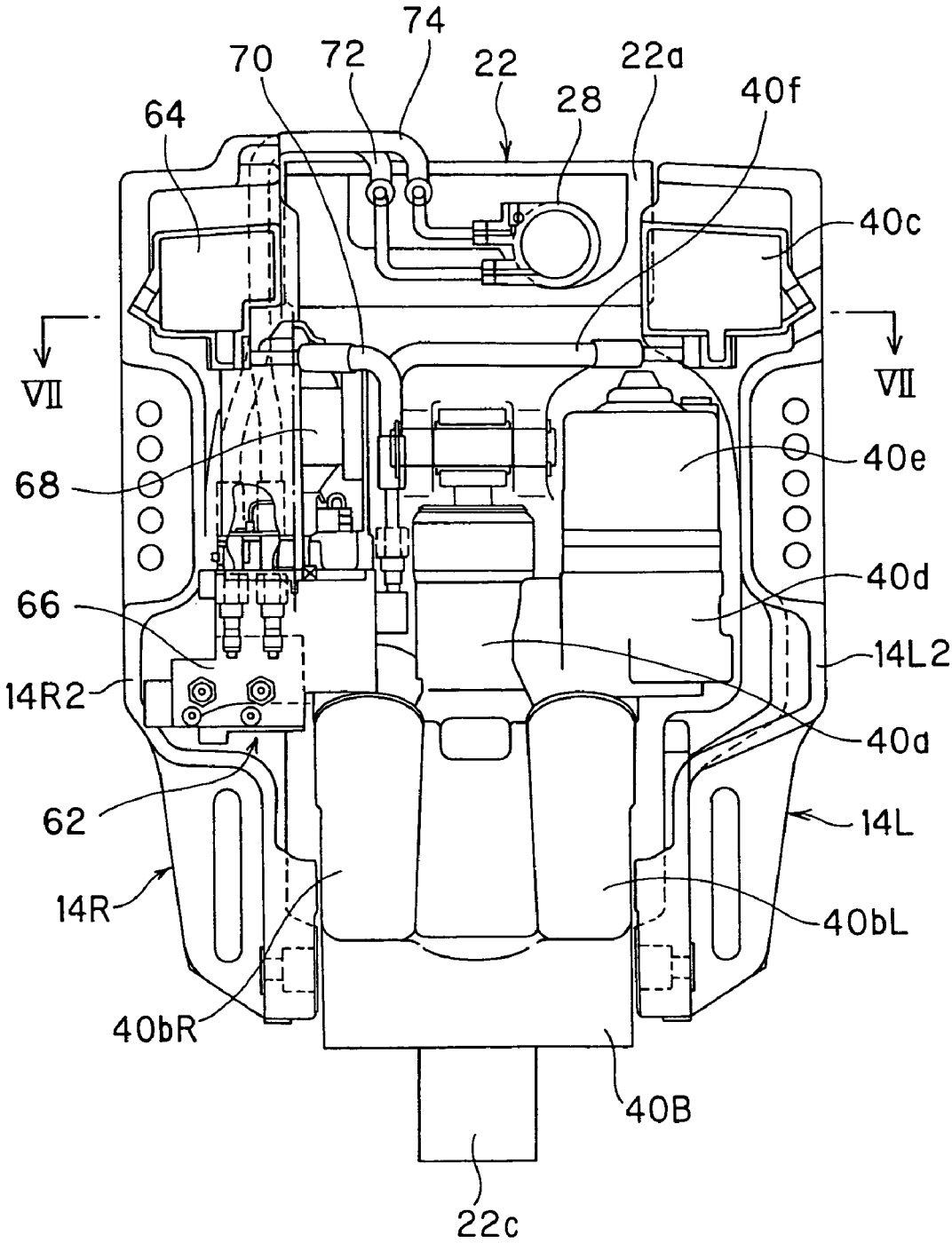
FIG. 6 is an enlarged partial cross section of the area around the stern brackets and swivel case shown in FIG. 2, etc., when viewed from the boat side.

FIG. 6 is an enlarged partial cross section of the area around the stern brackets 14 and swivel case 22 when viewed from the boat side. In addition, FIG. 7 is a cross section along the line VII-VII of FIG. 6.

Figure 7:
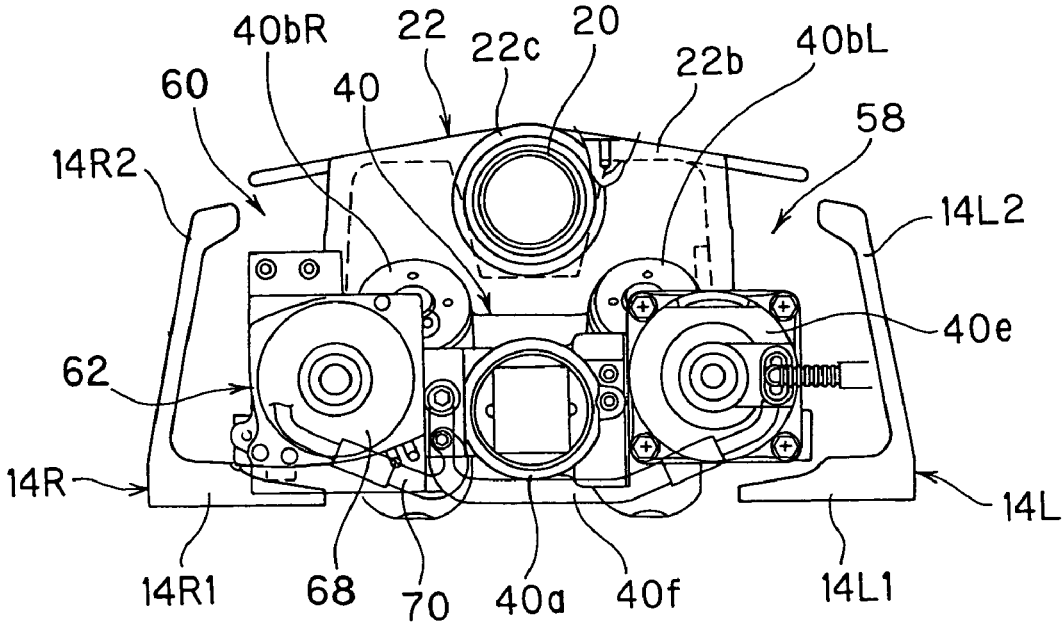
FIG. 7 is a cross section along the line VII-VII of FIG. 6.

As shown in FIGS. 4, 6 and 7, a hydraulic fluid supply mechanism 62 that supplies hydraulic fluid to the aforementioned steering hydraulic cylinder 28 is disposed in a space formed between the stern brackets 14 and swivel case 22, or specifically a space (indicated by the symbol 60 in FIG. 3 and FIG. 7) surrounded by the wall portions 14L2 and 14R2 of the left-side and right-side stern brackets, and wall portion 22*a* and wall portion 22*b* of the swivel case, and is thus incorporated into the outboard motor 10 as a unit.

The hydraulic fluid supply mechanism 62 comprises a reservoir tank 64 (not shown in FIG. 4) that stores hydraulic fluid, a hydraulic pump 66 that pumps hydraulic fluid stored in the reservoir tank 64 and sends the pressurized hydraulic fluid to the steering hydraulic cylinder, and an electric motor 68 connected thereto to drive the hydraulic pump 66. Thus, in this embodiment, all of the components related to the hydraulic pressure supply system are incorporated into the outboard motor 10 as a unit, so that the steering mechanism 18 is self-contained in the interior of the outboard motor 10.

In addition, the aforementioned power tilt/trim unit 40 is disposed within the space 60 adjacent to the hydraulic fluid supply mechanism 62.

Figure 8:
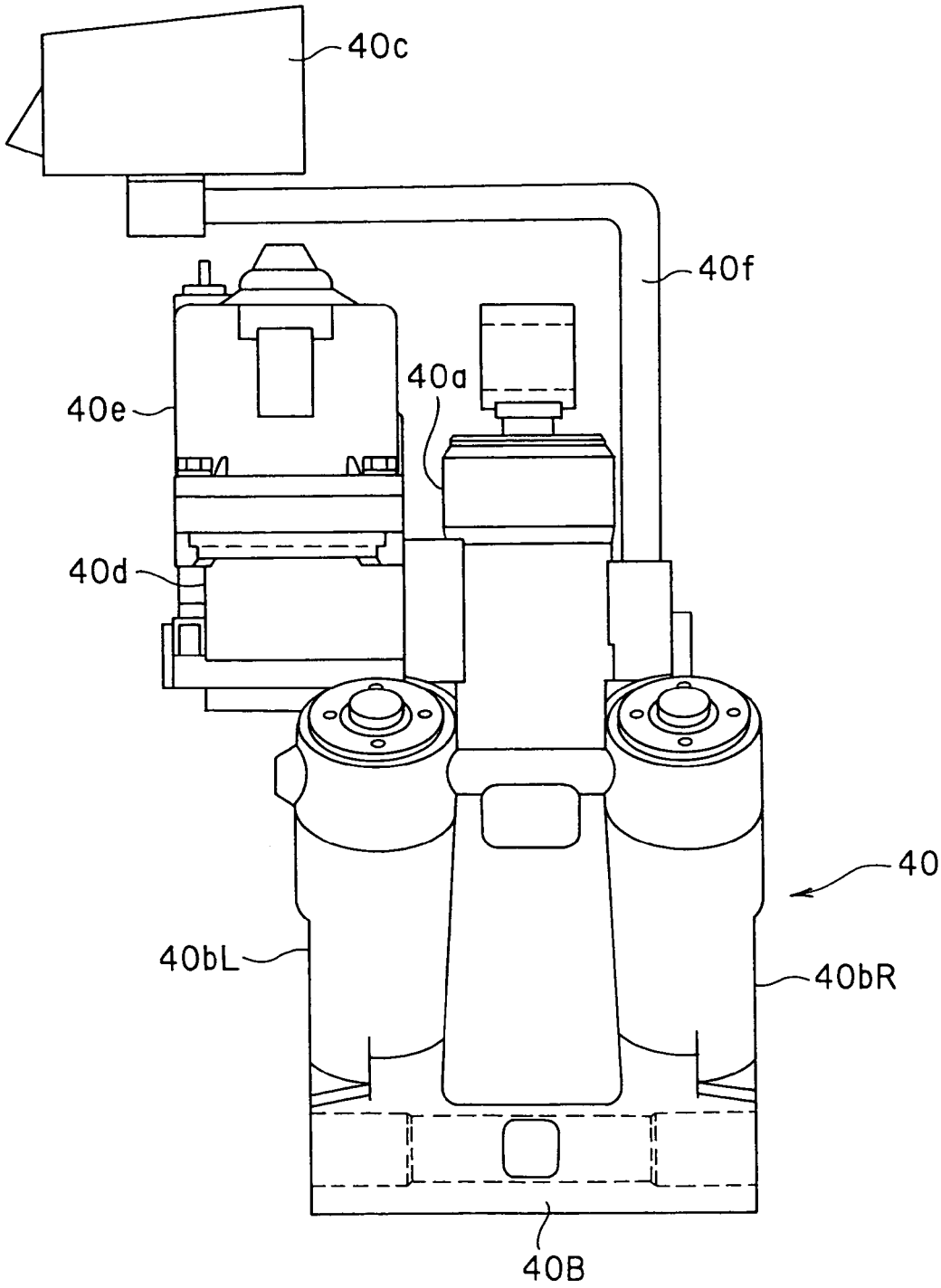
FIG. 8 is a top view of a power tilt/trim unit when seen from the side of the outboard motor main unit.

FIG. 8 is a top view of the power tilt/trim unit 40 when seen from the side of the outboard motor main unit 16. As shown in FIG. 8, the power tilt/trim unit 40 comprises: a hydraulic cylinder for adjusting the tilt angle (hereinafter called the "tilt hydraulic cylinder") 40*a*, two hydraulic cylinders for adjusting the trim angle (hereinafter called the "trim hydraulic cylinders") 40*b*L and 40*b*R disposed to the left and right thereof, a reservoir tank 40*c* that stores hydraulic fluid, a hydraulic pump 40*d* that pumps the hydraulic fluid stored in the reservoir tank 40*c* and outputs the pressurized hydraulic fluid to the tilt hydraulic cylinder 40*a* and trim hydraulic cylinders 40*b*L and 40*b*R, and an electric motor 40*e* that drives the hydraulic pump 40*d*.

The trim hydraulic cylinders 40*b* have cylinders formed of a length (length in the stroke direction) shorter than that of the tilt hydraulic cylinder 40*a* and also are disposed at an inclined angle on either side of the tilt hydraulic cylinder 40*a*. Hereinafter, the trim hydraulic cylinder 40*b*L disposed on the left side of the tilt hydraulic cylinder 40*a* when viewed in the direction of forward motion shall be called the "left-side trim hydraulic cylinder" and the trim hydraulic cylinder 40*b*R disposed on the right side shall be called the "right-side trim hydraulic cylinder."

The hydraulic pump 40*d* is disposed above the left-side trim hydraulic cylinder 40*b*L and to the left of the tilt hydraulic cylinder 40*a*, and the electric motor 40*e* connected thereto is disposed on top of the hydraulic pump 40*d*. Specifically, the hydraulic pump 40*d* and electric motor 40*e* are mounted on the left side of the tilt hydraulic cylinder 40*a*.

The hydraulic pump 40*d* is connected to a hydraulic circuit (not shown) provided in the interior of the power tilt/trim unit 40. In addition, the reservoir tank 40*c* is disposed above the electric motor 40*e* and the reservoir tank 40*c* is connected to the aforementioned hydraulic circuit via a fluid path 40*f*.

Here follows a detailed description of the positional relationship between the power tilt/trim unit 40 and the hydraulic fluid supply mechanism 62 made with reference to FIGS. 4, 6 and 7.

As shown in the figures, the power tilt/trim unit 40 is disposed in the center of the space 60 formed between the stern brackets 14 and the swivel case 22, and the lower portion 40B thereof, or specifically the cylinder bottoms of the tilt hydraulic cylinder 40*a* and trim hydraulic cylinders 40*b*L and 40*b*R, is connected to the stern brackets 14. On the other hand, the rod head of the tilt hydraulic cylinder 40*a* is connected to the wall portion 22*b* of the swivel case 22 and also the rod heads of the left and right trim hydraulic cylinders 40*b*L and 40*b*R are in contact with the wall portion 22*b* of the swivel case 22. Thereby, when the rod of the tilt hydraulic cylinder 40*a* or the rods of the trim hydraulic cylinders 40*b*L and 40*b*R extend or retract, the swivel case 22 rotates around the tilting shaft 26 as the axis of rotation, thus adjusting the tilt angle and trim angle of the outboard motor main unit 16. As shown in FIG. 6, the reservoir tank 40*c* is attached to the left-side stern bracket 14L.

The hydraulic fluid supply mechanism 62 is disposed on the right side of the power tilt/trim unit 40, or specifically above the right-side trim hydraulic cylinder 40*b*R and to the right of the tilt hydraulic cylinder 40*a*.

More specifically, the hydraulic pump 66 is disposed above the right-side trim hydraulic cylinder 40*b*R and the electric motor 68 connected thereto is disposed above the hydraulic pump 66. Specifically, the hydraulic pump 66 and electric motor 68 are attached to the right side of the of the tilt hydraulic cylinder 40*a*. Moreover, the reservoir tank 64 is disposed above the electric motor 68. As shown in FIG. 6, the reservoir tank 64 is attached to the right-side stern bracket 14R.

The hydraulic pump 66, electric motor 68 and reservoir tank 64 constituting the hydraulic fluid supply mechanism 62 and the hydraulic pump 40*d*, electric motor 40*e* and reservoir tank 40*c* of the power tilt/trim unit 40 are disposed such that they face each other, respectively, across the tilt hydraulic cylinder 40*a* in between. The reservoir tank 64 and hydraulic pump 66 are connected via a fluid path 70 disposed in the interior of the space 60. In addition, the hydraulic pump 66 is connected to the steering hydraulic cylinder 28 via fluid path 72 and fluid path 74.

In this manner, the outboard motor steering system according to this first embodiment of the invention is configured such that the steering mechanism 18 of the outboard motor 10 comprises the swivel case 22 attached to stern brackets 14, the swivel shaft 20 rotatably housed in the swivel case 22, the steering hydraulic cylinder 28 that rotates the swivel shaft 20 and the hydraulic fluid supply mechanism 62 that supplies hydraulic fluid to the steering hydraulic cylinder 28, and also, the hydraulic fluid supply mechanism 62 is disposed in the space 60 formed between the stern brackets 14 and the swivel case 22, or namely the hydraulic fluid supply mechanism 62 is incorporated into the outboard motor 10 as a unit, so the structure can be made simpler than that of the related art and the number of parts in the entire system can be reduced and moreover the work of installation into the boat's hull can be simplified.

Further, the hydraulic fluid supply mechanism 62 is constituted in comprising the reservoir tank 64 that stores hydraulic fluid, the hydraulic pump 66 that pumps hydraulic fluid stored in the reservoir tank 64 and supplies the pressured hydraulic fluid to the steering hydraulic cylinder 28, and the electric motor 68 that drives the hydraulic pump 66, or namely all of the components related to the hydraulic pressure supply system are incorporated into the outboard motor 10 as a unit, and thus the steering mechanism 18 is self-contained in the interior of the outboard motor 10, so the number of parts in the entire system can be reduced further and moreover the work of installation into the boat can be even more simplified.

Furthermore, the hydraulic fluid supply mechanism 62 is disposed in the space 60 adjacent to the power tilt/trim unit 40, thereby making effective usage of the space in the interior of the outboard motor 10, so it is possible to suppress the effect of making the entire outboard motor much larger even if the hydraulic fluid supply mechanism 62 is disposed as a unit with the outboard motor 10.

Next, an outboard motor steering system according to a second embodiment of the invention will be explained.

Figure 9:
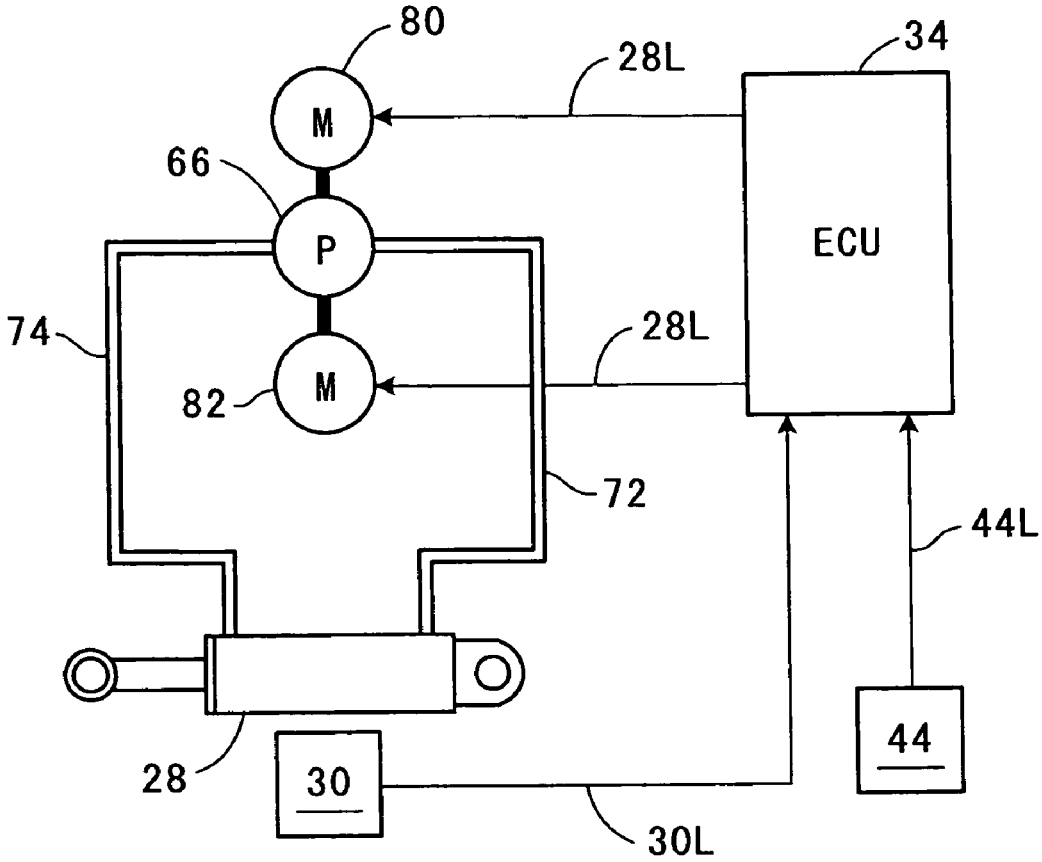
FIG. 9 is a block diagram illustrating the operation of an outboard motor steering system according to a second embodiment.

FIG. 9 is a block diagram illustrating the operation of an outboard motor steering system according to the second embodiment. It should be noted that the same symbols are applied to the same constituent elements as in the first embodiment and an explanation thereof is omitted.

As shown in FIG. 9, the steering system according to this embodiment is provided with a plurality of electric motors, specifically two, that drive the hydraulic pump 66. In the following, the electric motor indicated with the symbol 80 is called the "first electric motor" and the electric motor indicated with the symbol 82 is called the "second electric motor." It should be noted that the hydraulic pump 66 and the first and second electric motors 80 and 82 may be disposed within the space 60 in the same manner as in the first embodiment, or they may also be disposed in another area of the outboard motor 10 such as above the swivel case 22 or the like. In addition, the reservoir tank 64 is omitted from the figure.

Here, if we let the output torque of the first electric motor 80 be $T_1$ and the output torque of the second electric motor 82 be $T_2$, and let $\alpha$ be the driving force of the hydraulic pump 66 required when the steering load on the outboard motor 10 (driving force on the steering hydraulic cylinder 28 required to adjust the steering angle) is a maximum, then these variables are set so as to satisfy the following relationships.

$$\alpha > T_1 \quad (1)$$

$$\alpha > T_2 \quad (2)$$

$$\alpha < T_1 + T_2 \quad (3)$$

The output torque values $T_1$ and $T_2$ are set such that when the steering load on the outboard motor 10 is a maximum, the output torque of each of the first electric motor 80 and second electric motor 82 individually is inadequate, but the combined torque of the two can handle the maximum load.

Continuing the description of FIG. 9, the ECU (motor controller) 34 controls the driven stroke and driven speed of the steering hydraulic cylinder 28 so that the steering angle of the outboard motor 10 detected by the steering angle sensor 30 becomes a value corresponding to the steering wheel angle of the steering wheel 42 detected by the steering wheel angle sensor 44. Specifically, upon detecting the steering load on the outboard motor 10, the ECU determines the number of electric motors to be used to drive the hydraulic pump 66 based on the steering load thus detected and then controls the driving thereof.

Figure 10:
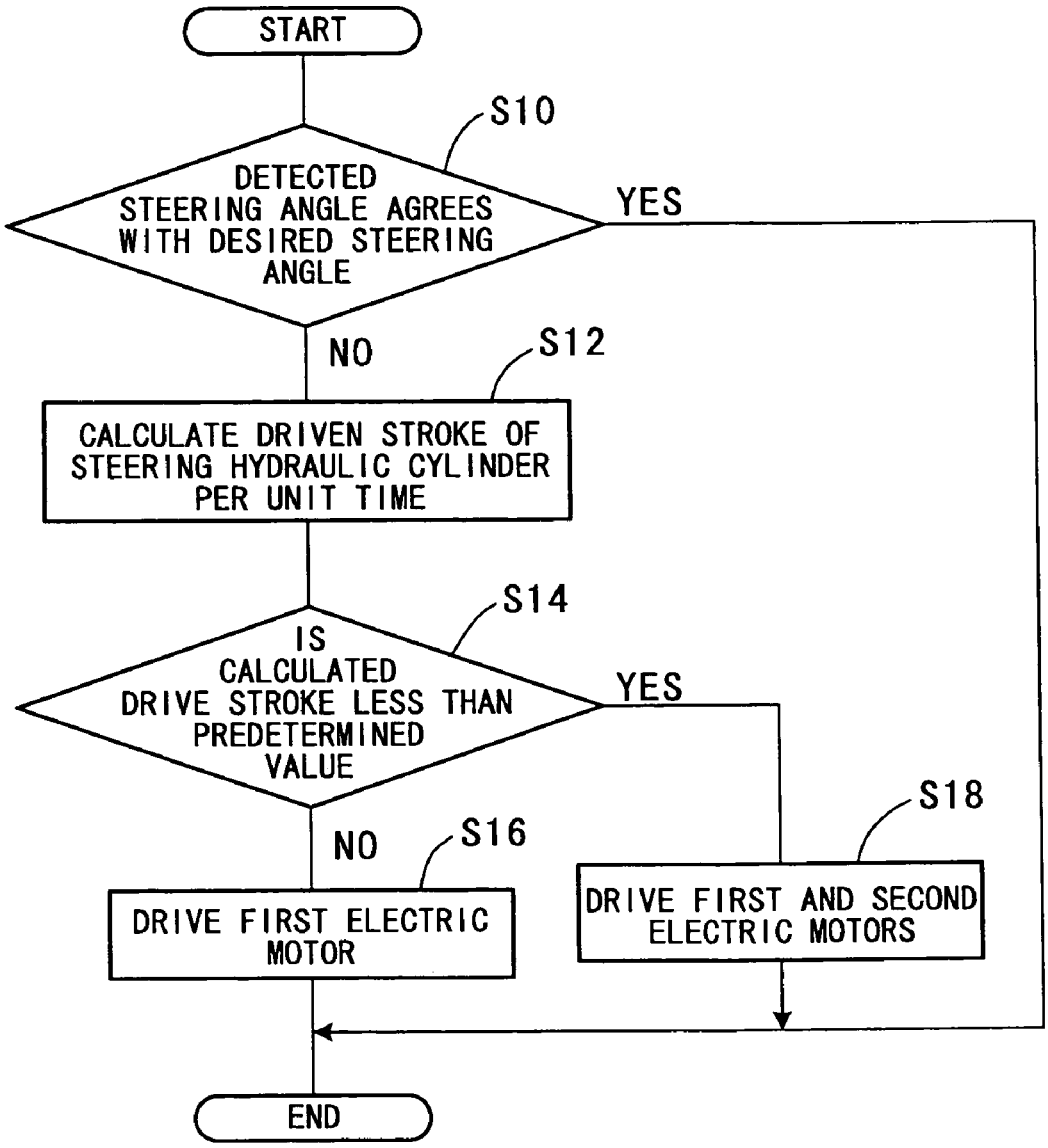
FIG. 10 is a flowchart illustrating control of the driving of a first electric motor and a second electric motor shown in FIG. 9.

FIG. 10 is a flowchart illustrating control of the driving of the first electric motor 80 and second electric motor 82 by the ECU 34. The illustrated program may be executed once every 10 ms, for example, or another predetermined period.

First in S10, a determination is made as to whether or not the steering angle detected by the steering angle sensor 30 (or specifically the driven stroke of the steering hydraulic cylinder 28) agrees with the desired steering angle. Here, the desired steering angle is defined to be a value found depending on the steering wheel angle of the steering wheel 42 detected by the steering wheel angle sensor 44. For example, if the steering angles of the outboard motor 10 are such that the angle from the neutral position to the maximum steering angle is 30°, and the steering wheel angles of the steering wheel 42 are such that the angle from the neutral position to the maximum steering wheel angle is 360°, then the desired steering angle is increased or decreased by 1° for every 12° of change in the angle of the steering wheel 42.

If YES results in S10, then the remaining process is skipped, but if NO results in S10, the program advances to S12 where the driven stroke of the steering hydraulic cylinder 28 per unit time (e.g., 1 s), or in other words the amount of change in the steering angle, is calculated.

As described above, the steering load of an outboard motor varies greatly depending on the type of boat, its speed, the wave conditions and the like. The output torque values $T_1$ and $T_2$ of the first electric motor 80 and the second electric motor 82 are set as described above to relatively small values such that the torque is inadequate when the steering load is a maximum. For this reason, the driven stroke per unit time of the steering hydraulic cylinder 28 decreases as the steering load increases. By calculating the driven stroke per time unit for the steering hydraulic cylinder 28, it is possible to estimate (detect) the magnitude of the steering load on the outboard motor 10.

The program next advances to S14, in which a determination is made as to whether or not the calculated driven stroke per unit time of the steering hydraulic cylinder 28 is less than a predetermined value, or in other words, whether or not the steering load is greater than a predetermined value.

If NO results in S14, then the steering load is determined to be small and the program advances to S16, where the driving of the first electric motor 80 is controlled such that the detected value of the steering angle agrees with the desired steering angle. On the other hand, if YES results in S14, then the steering load is determined to be large and the program advances to S18, where the driving of the first electric motor 80 and the second electric motor 82 is controlled such that the detected value of the steering angle agrees with the desired steering angle.

When the steering load is small, the output torque and power consumption can be kept to the minimum levels required by driving only the first electric motor 80, but when the steering load is large, both of the two electric motors 80 and 82 are driven to increase the output torque and thus increase the driving force of the hydraulic pump 66, or in other words, increase the driving force of the steering hydraulic cylinder 28.

Having been configured in the foregoing manner, the outboard motor steering system according to the second embodiment of the invention is such that a plurality of (i.e., two) electric motors 80 and 82 are provided as the source of driving force for a hydraulic pump 66 that supplies hydraulic fluid to a steering hydraulic cylinder 28, and also, upon detecting the steering load acting on the outboard motor 10, the number of electric motors to be used to drive the hydraulic pump 66 is determined based on the steering load thus detected and then the driving thereof is controlled. The number of electric motors to be driven increases or decreases depending on the steering load, so the output torque values $T_1$ and $T_2$ of the first electric motor 80 and the second electric motor 82 can be set to relatively small values in comparison to the related art, and thus the operating efficiency of the electric motors can be increased and the power consumption can be reduced.

In addition, upon detecting the driven stroke per unit time of the steering hydraulic cylinder 28 and also estimating the steering load acting on the outboard motor 10 based on the detected value, it is possible to estimate (or detect) the magnitude of the steering load acting on the outboard motor 10 using the sensors and control systems provided in a conventional steering system, so this is advantageous from a cost standpoint and also this prevents the work of assembling an outboard motor from becoming complex.

An outboard motor steering system according to a third embodiment of the invention will be explained.

Figure 11:
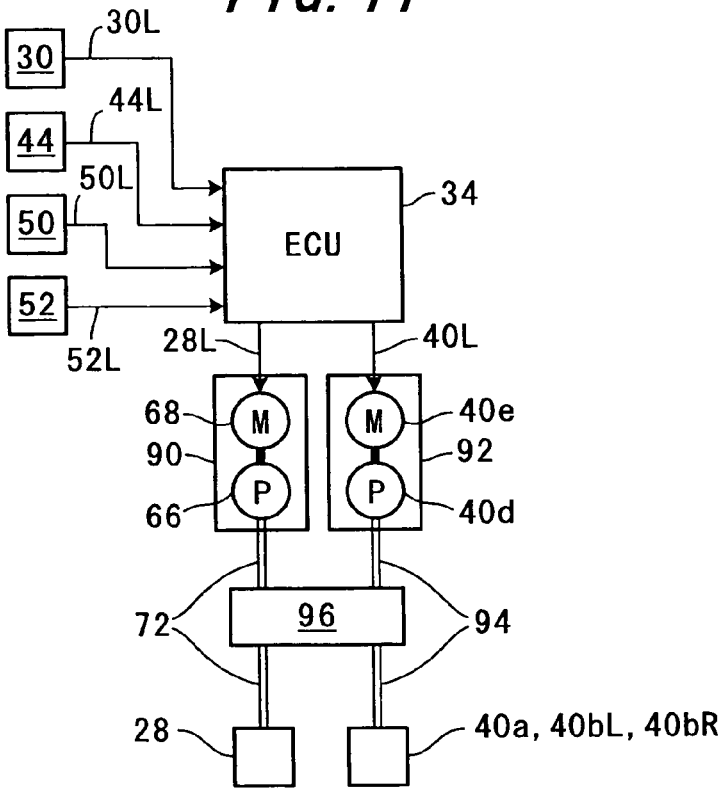
FIG. 11 is a block diagram illustrating the operation of an outboard motor steering system according to a third embodiment.

FIG. 11 is a block diagram illustrating the operation of an outboard motor steering system according to the third embodiment. It should be noted that the same symbols are applied to the same constituent elements as in the first embodiment and an explanation thereof is omitted.

In this embodiment, the hydraulic pump 66 that pumps hydraulic fluid and supplies the pressurized hydraulic fluid to the steering hydraulic cylinder 28 is called the "steering hydraulic pump" and the electric motor 68 that drives it is called the "steering electric motor." In addition, as shown in FIG. 11, the steering hydraulic pump 66 and steering electric motor 68 when taken together are called the "first hydraulic fluid supply source" and given the symbol 90.

On the other hand, the hydraulic pump 40*d* that pumps and supplies the pressurized hydraulic fluid to the tilt hydraulic cylinder 40*a* and trim hydraulic cylinders 40*b*L and 40*b*R is called the "tilt/trim hydraulic pump," and the electric motor 40*e* that drives it is called the "tilt/trim electric motor."

In addition, the tilt/trim hydraulic pump 40*d* and tilt/trim electric motor 40*e* when taken together are called the "second hydraulic fluid supply source" and given the symbol 92. Moreover, the tilt hydraulic cylinder 40*a* and trim hydraulic cylinders 40*b*L and 40*b*R when taken together are called the "tilt/trim hydraulic cylinders" and the fluid path that connects the tilt/trim hydraulic pump 40*d* to the tilt/trim hydraulic cylinders 40*a*, 40*b*L and 40*b*R is indicated with the symbol 94.

Based on the outputs of the steering angle sensor 30, steering wheel angle sensor 44, power tilt switch 50 and power trim switch 52, the ECU 34 controls the first hydraulic fluid supply source 90 that supplies hydraulic fluid to the steering hydraulic cylinder 28 and the second hydraulic fluid supply source 92 that supplies hydraulic fluid to the tilt/trim hydraulic cylinders 40*a*, 40*b*L and 40*b*R.

The third embodiment is characterized in that a selector valve (fluid diverter) 96 is provided between fluid path 72 and fluid path 94, so that hydraulic fluid that should be supplied to one of the steering hydraulic cylinder 28 and the tilt/trim hydraulic cylinders 40*a*, 40*b*L and 40*b*R may be supplied to the other, or namely the destination of supply of hydraulic fluid can be freely changed between the steering system and the tilt/trim system.

It should be noted that as described previously, both the steering hydraulic cylinder 28 and the tilt/trim hydraulic cylinders 40*a*, 40*b*L and 40*b*R are reciprocating hydraulic cylinders so in fact another set comprising a fluid path and selector valve is provided, but both have the same constitution so they are omitted from the figures and description.

Figure 12:
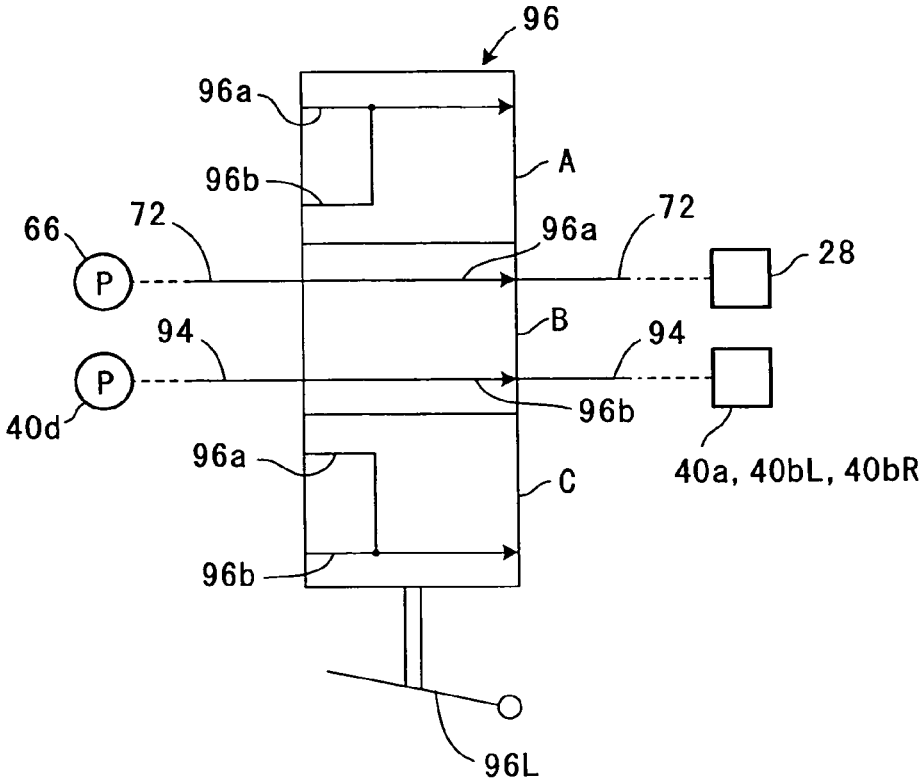
FIG. 12 is a hydraulic circuit diagram for a selector valve shown in FIG. 11.

FIG. 12 is a hydraulic circuit diagram for the selector valve 96.

As shown in FIG. 12, the selector valve 96 has three positions labeled A, B and C. The selector valve 96 is provided with a selector lever 96L connected to a spool (not shown) and can thus be freely switched by manually operating the selector lever 96L so as to select one of the positions A, B or C.

To describe the selector valve 96 in more detail, the selector valve 96 comprises a first fluid path 96*a* (namely a portion of the aforementioned fluid path 72) that connects the steering hydraulic pump 66 to the steering hydraulic cylinder 28, and a second fluid path 96*b* (namely a portion of the aforementioned fluid path 94) that connects the tilt/trim hydraulic pump 40*d* to the tilt/trim hydraulic cylinders 40*a*, 40*b*L and 40*b*R.

Among the three positions A, B and C, position B is the neutral position. When position B is selected, the hydraulic fluid pumped from the steering hydraulic pump 66 under pressure passes through fluid path 72 and the first fluid path 96*a* within the selector valve 96, and is supplied to the steering hydraulic cylinder 28. In addition, the hydraulic fluid sent from the tilt/trim hydraulic pump 40*d* under pressure passes through the fluid path 94 and the second fluid path 96*b* within the selector valve 96, and is supplied to the tilt/trim hydraulic cylinders 40*a*, 40*b*L and 40*b*R.

Figure 13:
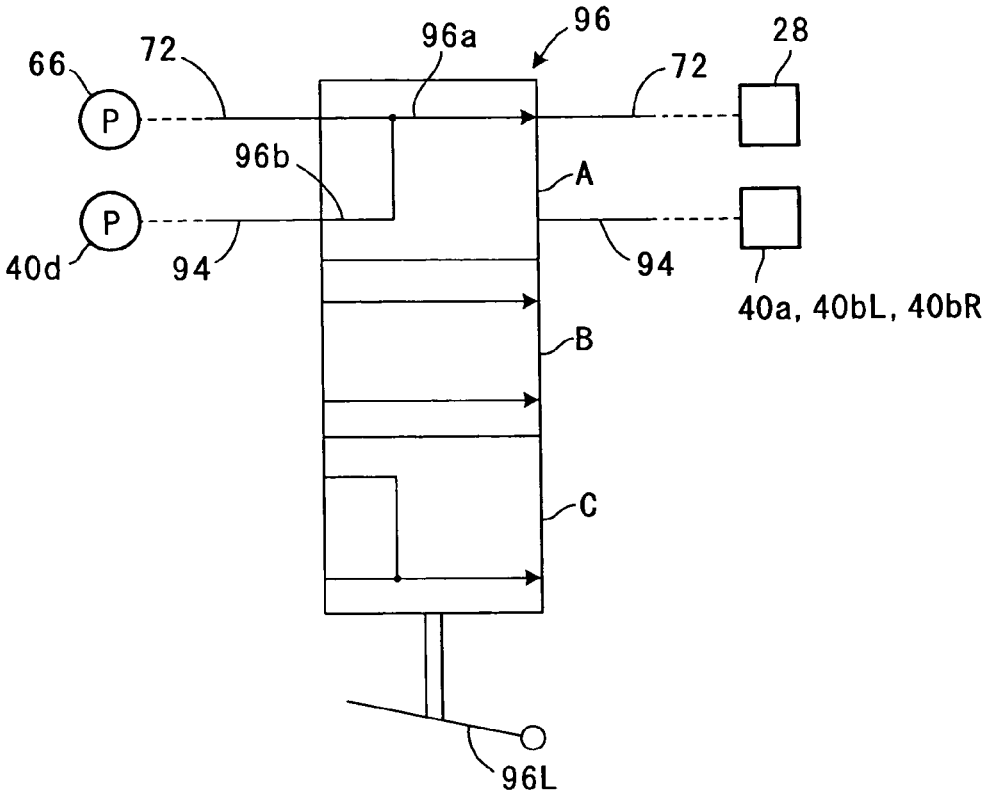
FIG. 13 is also a hydraulic circuit diagram similar to FIG. 12, for the selector valve shown in FIG. 11.

In contrast, when position A is selected, as shown in FIG. 13, the connection between the second fluid path 96*b* and the fluid path 94 downstream thereof is cut off and also, the second fluid path 96*b* communicates with the first fluid path 96*a*. Accordingly, in addition to the hydraulic fluid pumped from the steering hydraulic pump 66 under pressure, the steering hydraulic cylinder 28 is also supplied with the hydraulic fluid supplied from the tilt/trim hydraulic pump 40*d* under pressure. Thereby, the driving force of the steering hydraulic cylinder 28 is increased in comparison to the case in which hydraulic fluid is supplied by the steering hydraulic pump 66 alone.

Figure 14:
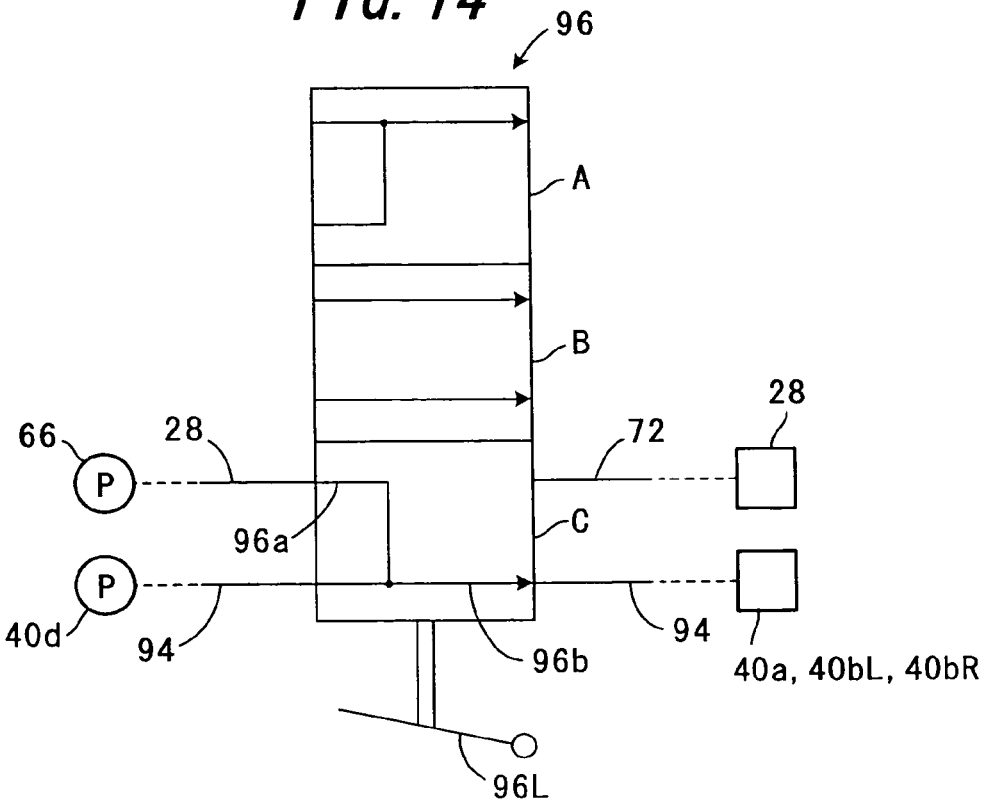
FIG. 14 is also a hydraulic circuit diagram similar to FIG. 12, for the selector valve shown in FIG. 11.

On the other hand, when position C is selected, as shown in FIG. 14, the connection between the first fluid path 96*a* and the fluid path 72 downstream thereof is cut off and also, the first fluid path 96*a* communicates with the second fluid path 96*b*. Accordingly, in addition to the hydraulic fluid sent from the tilt/trim hydraulic pump 40*d* under pressure, the tilt/trim hydraulic cylinders 40*a*, 40*b*L and 40*b*R are also supplied with the hydraulic fluid sent from the steering hydraulic pump 66 under pressure. Thereby, the driving force of the tilt/trim hydraulic cylinders 40*a*, 40*b*L and 40*b*R is increased in comparison to the case in which hydraulic fluid is supplied by the tilt/trim hydraulic pump 40*d* alone.

Having been configured in this manner, the outboard motor steering system according to the third embodiment of the invention is such that the steering hydraulic cylinder 28 that adjusts or regulate the steering angle of the outboard motor 10 relative to the boat 12, a first hydraulic fluid supply source 90 (specifically a steering electric motor 68 and steering hydraulic pump 66) that supplies hydraulic fluid thereto, tilt/trim hydraulic cylinders 40*a*, 40*b*L and 40*b*R that adjust or regulate the tilt/trim angle of the outboard motor 10 relative to the boat 12, and a second hydraulic fluid supply source 92 (specifically a tilt/trim electric motor 40*e* and tilt/trim hydraulic pump 40*d*) that supplies hydraulic fluid thereto are provided, and also a selector valve (fluid diverter) 96 by which hydraulic fluid that should be supplied to one of the steering hydraulic cylinder 28 and the tilt/trim hydraulic cylinders 40*a*, 40*b*L and 40*b*R may be supplied to the other, in other words the fluid diverter diverting at least a part of the hydraulic fluid to be supplied to one of the first and second hydraulic actuators, to the other of the first and second hydraulic actuators, is provided, so it is possible to supply hydraulic fluid from two hydraulic fluid supply sources 90 and 92 to a hydraulic actuator that is presented with increased load.

Thus, if the capacity to send hydraulic fluid under pressure (electric motor output torque and hydraulic pump volume) of the first hydraulic fluid supply source 90 and second hydraulic fluid supply source 92 is set so that the sum thereof can handle the maximum load, then it would be possible to adjust the steering angle and tilt/trim angle stably even should fluctuations in load arise. Accordingly, it is possible to set the capacity to send hydraulic fluid under pressure of the hydraulic fluid supply sources 90 and 92 to values smaller than those in the related art, and thus the hydraulic fluid supply sources (namely the electric motors 68 and 40*e* and hydraulic pumps 66 and 40*d*) can be made more compact and their power consumption can be reduced.

Further, the selector valve 96 is provided with a selector lever 96L that allows the destination of supply of hydraulic fluid to be selected, so the hydraulic actuator to which the supply of hydraulic fluid is to be increased can be readily changed at will by the operator.

An outboard motor steering system according to a fourth embodiment of the invention will be explained.

Figure 15:
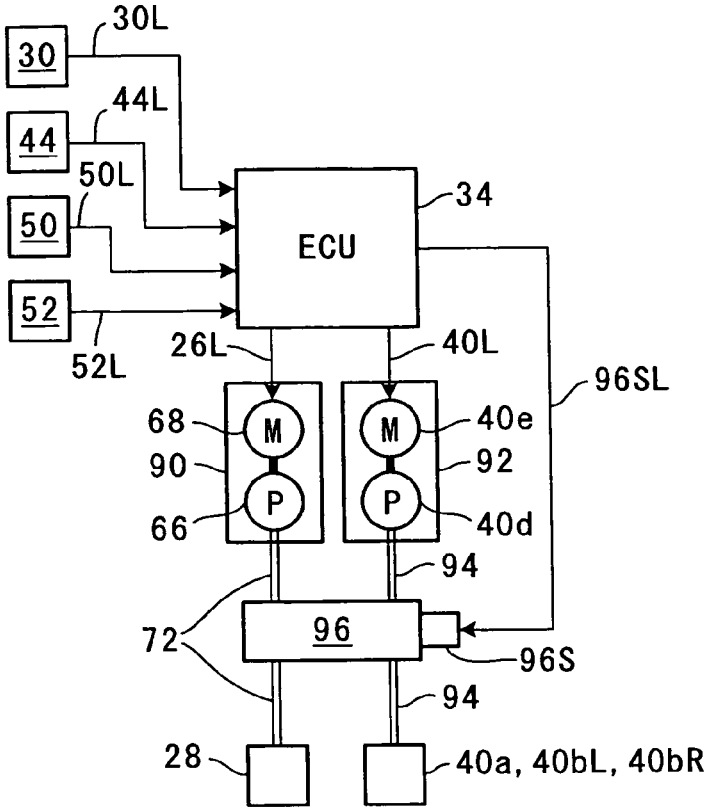
FIG. 15 is a block diagram illustrating the operation of an outboard motor steering system according to a fourth embodiment.
Figure 16:
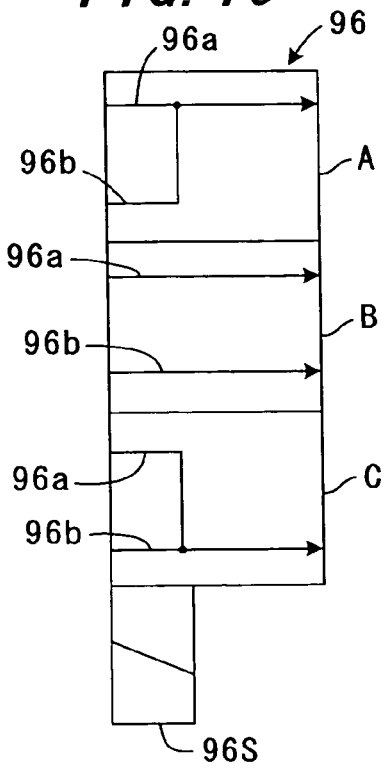
FIG. 16 is a hydraulic circuit diagram for the selector valve shown in FIG. 15.

FIG. 15 is a block diagram illustrating the operation of an outboard motor steering system according to the fourth embodiment. FIG. 16 is a hydraulic circuit diagram for the selector valve 96 shown in FIG. 15.

The explanation will be made with focus on points of difference from the third embodiment. In the fourth embodiment, the position of the selector valve 96 is switched automatically based on commands from the ECU 34.

To describe this in detail, as shown in FIGS. 15 and 16, the selector valve 96 is provided with an electromagnetic solenoid 96S instead of the aforementioned selector lever 96L. As shown in FIG. 15, the solenoid 96S is connected via a signal line 96SL to the ECU 34. The ECU 34 controls to energize or deenergize the solenoid 96S depending on the sensor outputs that indicate the state of operation of the outboard motor 10, or specifically depending on the output signals from the steering angle sensor 30, steering wheel angle sensor 44, power tilt switch 50 and power trim switch 52.

Figure 17:
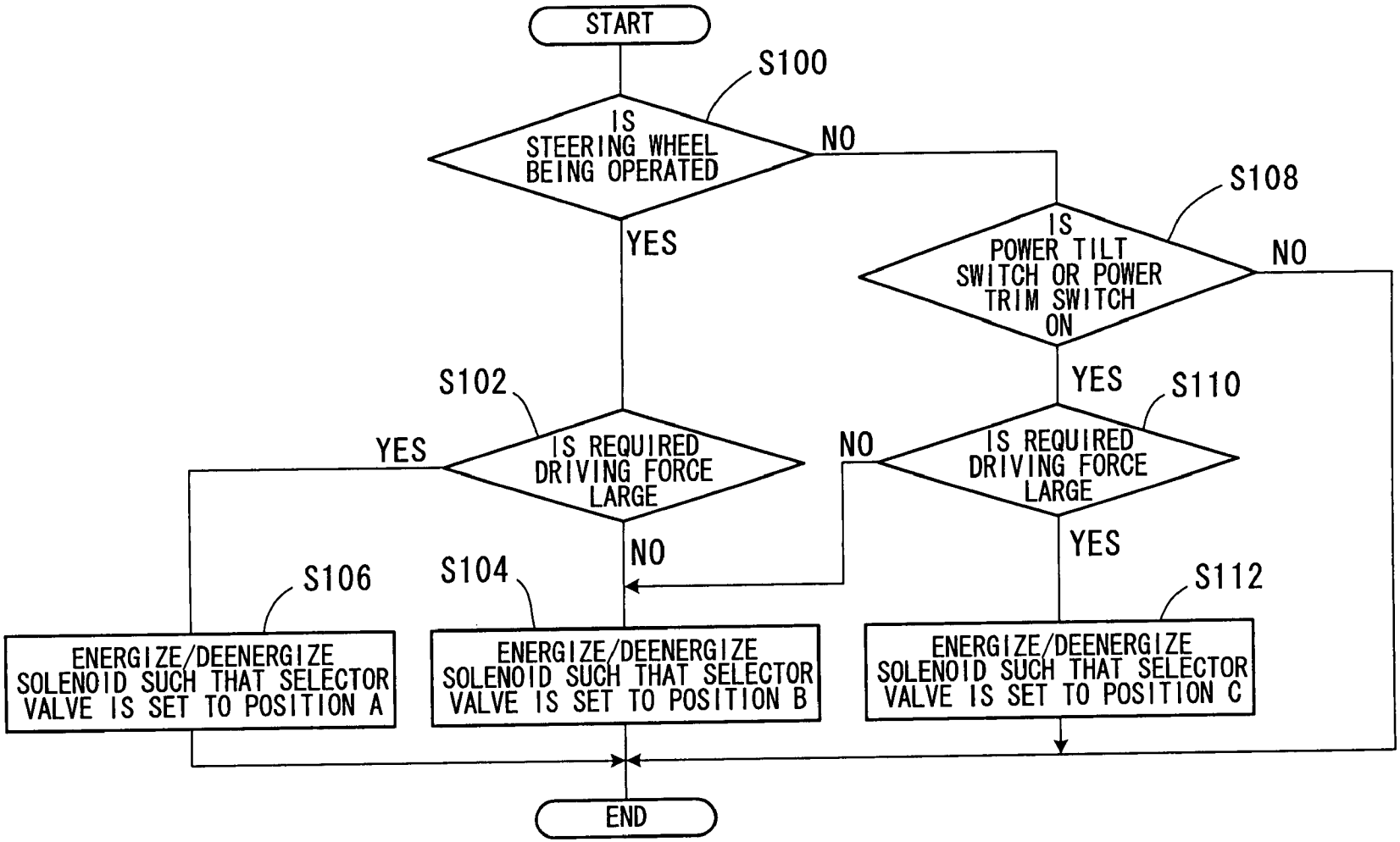
FIG. 17 is a flowchart illustrating the control of the operation of a solenoid shown in FIG. 15.

FIG. 17 is a flowchart illustrating the control of the operation of the solenoid 96S as executed by the ECU 34. The illustrated program may be executed once every 10 ms, for example.

To describe the procedure, first in S100, based on the output of the steering wheel angle sensor 44, a determination is made as to whether or not the operator is steering the steering wheel 42. If Yes results in S100, the program advances to S102, where a determination is made as to whether or not the steering load (in other words the driving force required to adjust the steering angle) is large. This determination may be made, for example, by determining whether or not the change in the steering angle per unit time detected by the steering angle sensor 30 is less than a predetermined value.

If No results in S102, the program advances to S104 where the solenoid 96S is energized/deenergized so that the selector valve 96 is set to position B which is the neutral position. On the other hand, if Yes results in S102, then the program advances to S106 where the solenoid 96S is energized/deenergized so that the selector valve 96 is set to position A, thus increasing the driving force of the steering hydraulic cylinder 28.

If No results in S100, the program advances to S108 where a determination is made as to whether or not the power tilt switch 50 or power trim switch 52 generates output of an ON signal, or namely whether or not the operator is operating the power tilt switch 50 or the power trim switch 52.

If No results in S108, then the remainder of the processing is skipped but if Yes results in S108, the program advances to S110 where a determination is made as to whether or not the driving force required to adjust the tilt/trim angle is large. This determination may be made by using a stroke sensor (not shown) to detect the change in the stroke per unit time of the tilt hydraulic cylinder 40*a* or hydraulic cylinders 40*b*L and 40*b*R, and determining whether or not the detected value is less than a predetermined value.

If No results in S110, the program then advances to S104 where the solenoid 96S is energized/denerigzied so that the selector valve 96 is set to position B. On the other hand, if Yes results in S110, the program advances to S112 where the solenoid 96S is energized/deenergized so that the selector valve 96 is set to position C, thus increasing the driving force of the tilt/trim hydraulic cylinders 40*a*, 40*b*L and 40*b*R.

Having been configured in this manner, with the outboard motor steering system according to the fourth embodiment of the invention, the state of operation of the outboard motor 10 (whether or not the steering angle or tilt/trim angle of the outboard motor 10 is being adjusted, and moreover whether or not the driving force required for that adjustment is large) is detected based on output signals from the steering angle sensor 30, steering wheel angle sensor 44, power tilt switch 50 and power trim switch 52, and depending on the results thus detected the solenoid 96S is energized/deenerigzed to change the position of the selector valve 96, so the hydraulic actuator to which the amount of hydraulic fluid supplied is to be increased can be changed automatically, thus lessening the burden on the operator.

The remaining constituent elements of the fourth embodiment are the same as those of the third embodiment, so they will not be explained again.

An outboard motor steering system according to a fifth embodiment of the invention will be explained.

Figure 18:
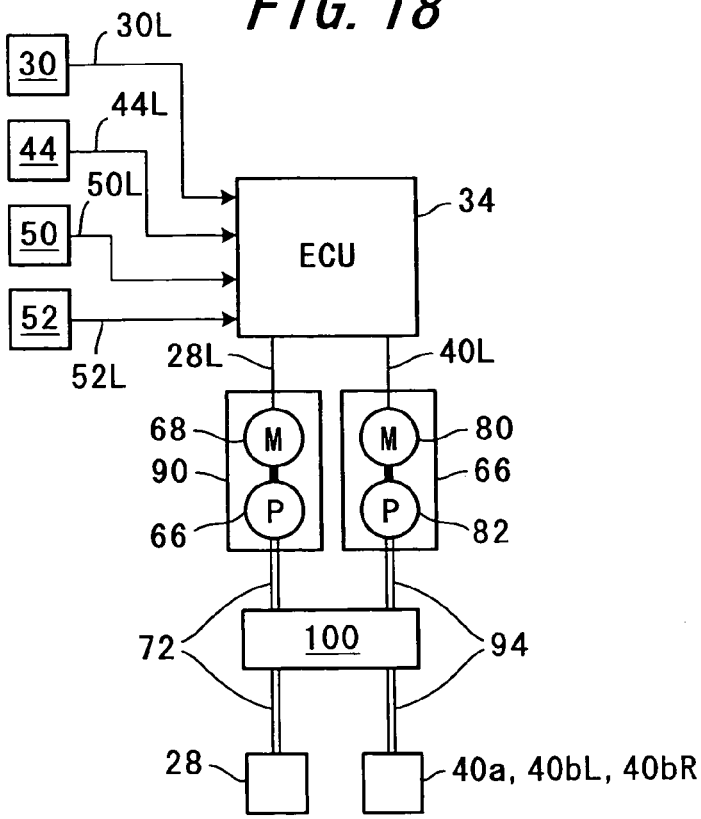
FIG. 18 is a block diagram illustrating the operation of an outboard motor steering system according to a fifth embodiment.

FIG. 18 is a block diagram illustrating the operation of an outboard motor steering system according to the fifth embodiment.

The explanation will be made in reference to FIG. 18 with focus on points of difference from the previous embodiment. In the fifth embodiment, a selector valve 100, by which at least part of the hydraulic fluid that should be supplied to one of the steering hydraulic cylinder 28 and the tilt/trim hydraulic cylinders 40*a*, 40*b*L and 40*b*R is diverted to the other, is provided between fluid path 72 and fluid path 94.

Figure 19:
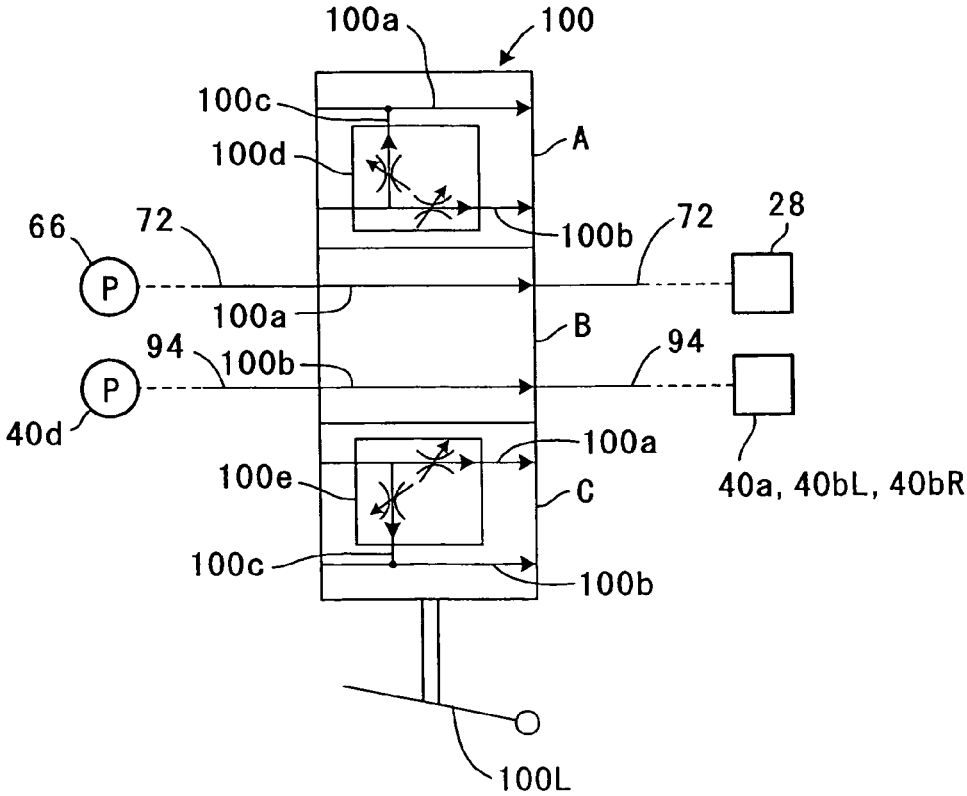
FIG. 19 is a hydraulic circuit diagram for the selector valve shown in FIG. 18.

FIG. 19 is a hydraulic circuit diagram for the selector valve 100 shown in FIG. 18.

As shown in FIG. 19, the selector valve 100 has three positions labeled A, B and C, which can be freely selected by manually operating a selector lever 100L to change the position of a spool (not shown).

To describe the selector valve 100 in more detail, the selector valve 100 comprises a first fluid path 100*a* (namely a portion of the aforementioned fluid path 72) that connects the steering hydraulic pump 66 to the steering hydraulic cylinder 28, a second fluid path 100*b* (namely a portion of the aforementioned fluid path 94) that connects the tilt/trim hydraulic pump 40*d* to the tilt/trim hydraulic cylinders 40*a*, 40*b*L and 40*b*R, a third fluid path (bypass line) 100*c* that connects the first fluid path 100*a* to the second fluid path 100*b*, a first flow dividing valve 100*d* that diverts at least part of the hydraulic fluid flowing through the second fluid path 100*b* to the first fluid path 100*a*, and a second flow dividing valve 100*e* that diverts at least part of the hydraulic fluid flowing through the first fluid path 100*a* to the second fluid path 100*b*.

Among the three positions A, B and C, position B is the neutral position. When position B is selected, all of the hydraulic fluid supplied from the steering hydraulic pump 66 under pressure passes through fluid path 72 and the first fluid path 100*a* within the selector valve 100, and is supplied to the steering hydraulic cylinder 28. On the other hand, all of the hydraulic fluid supplied from the tilt/trim hydraulic pump 40*d* under pressure passes through the fluid path 94 and the second fluid path 100*b* within the selector valve 100, and is supplied to the tilt/trim hydraulic cylinders 40*a*, 40*b*L and 40*b*R.

Figure 20:
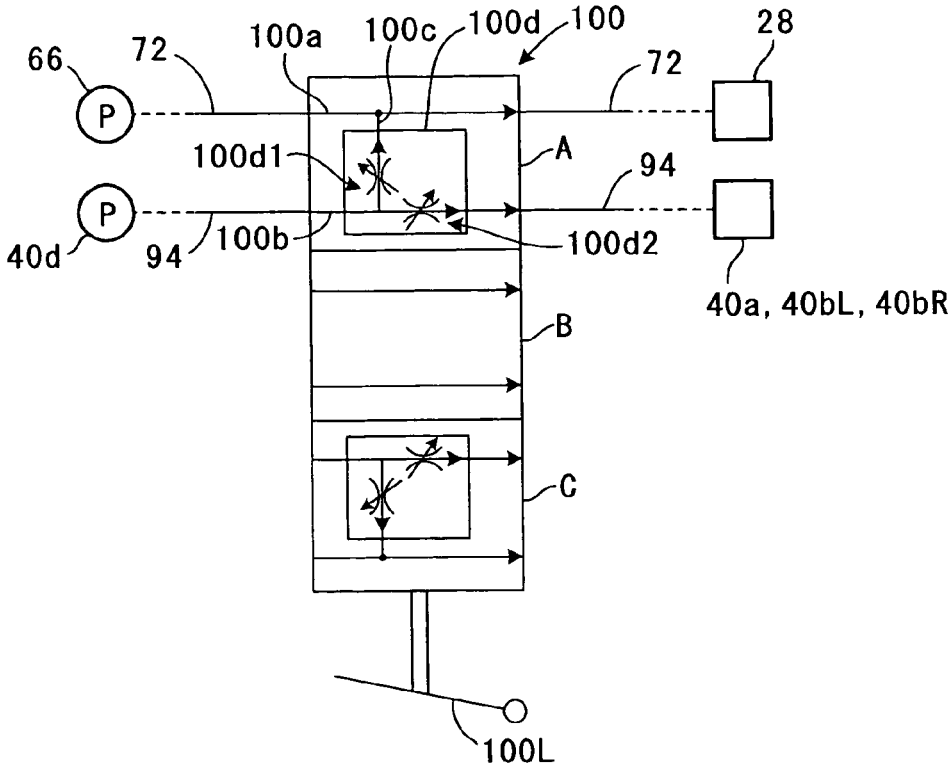
FIG. 20 is also a hydraulic circuit diagram similar to FIG. 19, for the selector valve shown in FIG. 18.

In contrast, when position A is selected, as shown in FIG. 20, at least part of the hydraulic fluid supplied under pressure from the tilt/trim hydraulic pump 40*d* is diverted via the first flow dividing valve 100*d* within the selector valve 100 and the third fluid path 100*c* to the first fluid path 100*a* and supplied to the steering hydraulic cylinder 28. Thereby, the driving power of the steering hydraulic cylinder 28 is increased in comparison to the case in which hydraulic fluid is supplied by the steering hydraulic pump 66 alone. It should be noted that in the same manner as when position B is selected, all of the hydraulic fluid sent under pressure from the steering hydraulic pump 66 is supplied to the steering hydraulic cylinder 28.

To describe the first flow dividing valve 100*d* in detail, the first flow dividing valve 100*d* comprises a first metering valve or restrictor 100*d*1 disposed in the third fluid path 100*c* and a second metering valve or restrictor 100*d*2 disposed at a location downstream of the third fluid path 100*c* in the second fluid path 100*b*.

The hydraulic fluid supplied from the tilt/trim hydraulic pump 40*d* under pressure is divided between the steering hydraulic cylinder 28 and the tilt/trim hydraulic cylinders 40*a*, 40*b*L and 40*b*R in proportion to the ratio of the cross-sectional area of the orifices of the first metering valve 100*d*1 and the second metering valve 100*d*2.

It should be noted that the first metering valve 100*d*1 and the second metering valve 100*d*2 are both variable throttles and their respective degrees of closure can be adjusted by the operator in a stepless manner. In addition, they are constituted such that their degrees of closure are continuously variable.

Specifically, when the degree of closure of the first metering valve 100*d*1 is increased (the flow rate is decreased), the degree of closure of the second metering valve 100*d*2 is decreased (the flow rate is increased) in inverse proportion thereto. On the other hand, when the degree of closure of the first metering valve 100*d*1 is decreased (the flow rate is increased), the degree of closure of the second metering valve 100*d*2 is increased (the flow rate is decreased) in inverse proportion thereto. The ratio of cross-sectional areas of the orifices of the first metering valve 100*d*1 and the second metering valve 100*d*2, or in other words the percentage of the hydraulic fluid diverted to the steering hydraulic cylinder 28, is adjustable. Accordingly, if the degree of closure of the second metering valve 100*d*2 is set to the maximum (setting the cross-sectional area of the orifice to zero), and the degree of closure of the first metering valve 100*d*1 is set to the minimum (setting the cross-sectional area of the orifice to the maximum), then all of the hydraulic fluid sent by the tilt/trim hydraulic pump 40*d* under pressure can be supplied to the steering hydraulic cylinder 28. It is in this sense that "at least part of the hydraulic fluid" is used above.

Figure 21:
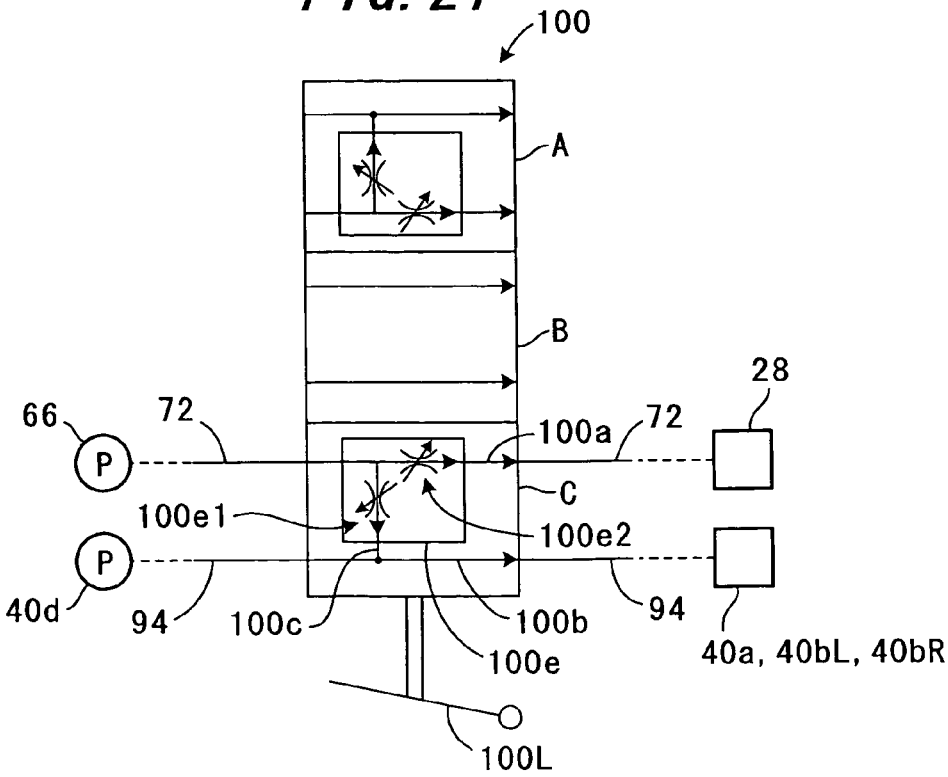
FIG. 21 is also a hydraulic circuit diagram similar to FIG. 19, for the selector valve shown in FIG. 18.

On the other hand, when position C is selected, as shown in FIG. 21, at least part of the hydraulic fluid sent from the steering hydraulic pump 66 under pressure is diverted to the second fluid path 100*b* via the second flow dividing valve 100*e* within the selector valve 100 and third fluid path 100*c* and supplied to the tilt/trim hydraulic cylinders 40*a*, 40*b*L and 40*b*R. Thereby, the driving force of the tilt/trim hydraulic cylinders 40*a*, 40*b*L and 40*b*R is increased in comparison to the case in which hydraulic fluid is supplied by the tilt/trim hydraulic pump 40*d* alone. It should be noted that in the same manner as when position B is selected, all of the pressurized hydraulic fluid pumped from the tilt/trim hydraulic pump 40*d* is supplied to the tilt/trim hydraulic cylinders 40*a*, 40*b*L and 40*b*R.

To describe the second flow dividing valve 100*e* in detail, the second flow dividing valve 100*e* comprises a third metering valve or restrictor 100*e*1 disposed in the third fluid path 100*c* and a fourth metering valve or restrictor 100*e*2 disposed at a location downstream of the third fluid path 100*c* in the first fluid path 100*a*.

The hydraulic fluid supplied from the steering hydraulic pump 66 under pressure is divided between the steering hydraulic cylinder 28 and the tilt/trim hydraulic cylinders 40*a*, 40*b*L and 40*b*R in proportion to the ratio of the cross-sectional area of the orifices of third metering valve 100*e*1 and the fourth metering valve 100*e*2.

It should be noted that the third metering valve 100*e*1 and fourth metering valve 100*e*2 are variable throttles in the same manner as the first and second metering valves 100*d*1 and 100*d*2 described above, and their respective degrees of closure can be adjusted by the operator in a stepless manner.

Further, they are constituted such that the degrees of closure of the third metering valve 100*e*1 and the fourth metering valve 100*e*2 are continuously variable (in inverse proportionality). The ratio of cross-sectional areas of the orifices of the third metering valve 100*e*1 and the fourth metering valve 100*e*2, or in other words the percentage of the hydraulic fluid diverted to the tilt/trim hydraulic cylinders 40*a*, 40*b*L and 40*b*R (the amount of the hydraulic fluid for which the supply destination is to be changed) is adjustable.

Having been configured in this manner, the outboard motor steering system according to the fifth embodiment of the invention is such that the selector valve 100 comprises: the first fluid path 100*a* that connects the steering hydraulic pump 66 to the steering hydraulic cylinder 28, the second fluid path 100*b* that connects the tilt/trim hydraulic pump 40*d* to the tilt/trim hydraulic cylinders 40*a*, 40*b*L and 40*b*R, the third fluid path 100*c* that connects the first fluid path 100*a* to the second fluid path 100*b*, the first flow dividing valve 100*d* comprising the first metering valve 100*d*1 disposed in the third fluid path 100*c* and the second metering valve 100*d*2 disposed at a location downstream of the third fluid path 100*c* in the second fluid path 100*b*, and the second flow dividing valve 100*e* comprising the third metering valve 100*e*1 disposed in the third fluid path 100*c* and the fourth metering valve 100*e*2 disposed at a location downstream of the third fluid path 100*c* in the first fluid path 100*a*, so by adjusting the degree of opening of the first through fourth metering valves, the percentage of the hydraulic fluid diverted to each of the hydraulic actuators, or in other words, the driving force of each of the hydraulic actuators can be adjusted depending on the load.

The remaining constituent elements are the same as those of the previous embodiment, so they will not be explained again.

Figure 22:
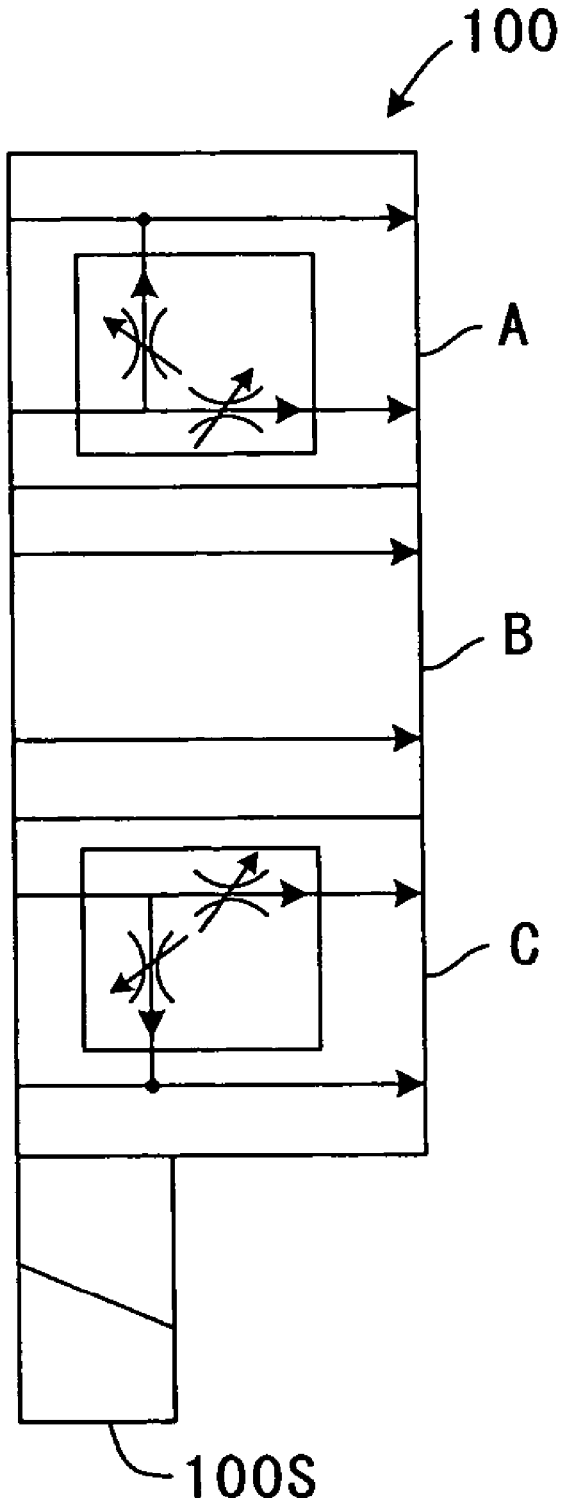
FIG. 22 is a diagram showing an alternative example of the hydraulic circuit diagram shown in FIG. 19.

As shown in FIG. 22, the selector valve 100 may be provided with the electromagnetic solenoid 100S instead of the manual selector lever 100L in the same manner as in the fourth embodiment.

As mentioned above, the first to fifth embodiments are thus configured to have a system for steering an outboard motor (10) mounted on a stern of a boat (12) through stern brackets (14) and having a steering mechanism (18) to steer the outboard motor relative to the boat, comprising: a swivel case (22) attached to the stern brackets; a swivel shaft (20) rotatably housed in the swivel case; a hydraulic actuator (steering hydraulic cylinder 28) connected to the swivel shaft to rotate the swivel shaft; and a hydraulic fluid supply mechanism (62) connected to the hydraulic actuator to supply hydraulic fluid to the hydraulic actuator; the hydraulic fluid supply mechanism being disposed in a space (60) formed between the stern brackets (14) and the swivel case (22).

In the system, the hydraulic fluid supply mechanism (62) comprises: a reservoir tank (64) storing the hydraulic fluid; a hydraulic pump (66) pumping the hydraulic fluid stored in the reservoir tank and supplying the pressurized hydraulic fluid to the hydraulic actuator; and an electric motor (68) connected to the hydraulic pump to drive the hydraulic pump.

The system further includes: a tilt/trim unit (power tilt/trim unit 40) disposed in the space and regulating a tilt/trim angle of the outboard motor relative to the boat; and wherein the hydraulic fluid supply mechanism (62) is disposed in the space (60) adjacent to the power tilt/trim unit.

As mentioned above, the first to fifth embodiments are thus configured to have a system for steering an outboard motor (10), mounted on a stern of a boat (12) through stern brackets (14), relative to the boat, comprising: a hydraulic actuator (steering hydraulic cylinder 28) regulating a steering angle of the outboard motor relative to the boat; a hydraulic pump (70) supplying hydraulic fluid to the hydraulic actuator; a plurality of electric motors (80, 82) driving the hydraulic pump; a steering load detector (stroke sensor, ECU 32, S12) detecting steering load acting on the outboard motor; and a motor controller (ECU 32, S14 to S18) determining a number of the electric motors to be used to drive the hydraulic pump based on the detected steering load and controlling operation of the determined number of the electric motors.

In the system, the steering load detector comprises; a driven stroke detector (ECU 32, S12) detecting a driven stroke per unit time of the hydraulic actuator; and a steering load estimator (ECU 32, S14) estimating the steering load based on the detected driven stroke per unit time of the hydraulic actuator.

As mentioned above, the first to fifth embodiments are thus configured to have a system for steering an outboard motor (10), mounted on a stern of a boat (12) through stern brackets (14), relative to the boat, comprising: a first hydraulic actuator (steering hydraulic cylinder 28) adjusting a steering angle of the outboard motor relative to the boat; a first hydraulic fluid supply source (90; specifically the steering electric motor 68 and steering hydraulic pump 66) supplying hydraulic fluid to the first hydraulic actuator; a second hydraulic actuator (tilt/trim hydraulic cylinders 40*a*, 40*b*) regulating a tilt/trim angle of the outboard motor relative to the boat; a second hydraulic fluid supply source (92; specifically the tilt/trim electric motor 40*e* and tilt/trim hydraulic pump 40*d*) supplying the hydraulic fluid to the second hydraulic actuator; and a fluid diverter (selector valve 96, 100) diverting at least a part of the hydraulic fluid to be supplied to one of the first and second hydraulic actuators, to the other of the first and second hydraulic actuators.

In the system, the fluid diverter includes: a first fluid path (100*a*) connecting the first fluid supply source to the first hydraulic actuator; a second fluid path (100*b*) connecting the second fluid supply source to the second hydraulic actuator; a third fluid path (100*c*) connecting the first fluid path to the second fluid path; a first flow dividing valve (100*d*) comprising a first metering valve disposed in the third fluid path and a second metering valve disposed in the second fluid path at a location downstream of the third fluid path; and a second flow dividing valve (100*e*) comprising a third metering valve disposed in the third fluid path and a fourth metering valve disposed in the first fluid path at a location downstream of the third fluid path.

In the system, the fluid diverter includes: a selector lever (96) allowing destination of supply of the hydraulic fluid to be diverted.

The system further includes: a plurality of sensors (steering angle sensor 30, steering wheel angle sensor 44, power tilt switch 50, power trim switch 52) detecting state of operation of the outboard motor; an electromagnetic solenoid (96S) allowing destination of supply of the hydraulic fluid to be diverted; and a control unit (ECU 34, S100 to S112) controlling to energize/deenergize the solenoid based on the detected state of operation of the outboard motor.

Japanese Patent Application No. 2004-178203 filed on Jun. 16, 2004, and Nos. 2004-181285 and 2004-181286 filed on Jun. 18, 2004, are incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A steering system for steering an outboard motor, mounted on a stern of a boat through stern brackets, relative to the boat, said steering system comprising:

a hydraulic actuator for regulating a steering angle of the outboard motor relative to the boat;

a hydraulic pump for supplying hydraulic fluid to the hydraulic actuator;

a plurality of electric motors for driving the hydraulic pump;

a steering load determining device for determining a steering load acting on the outboard motor; and a motor controller for determining a number of the electric motors to be used to drive the hydraulic pump based on the determined steering load and for controlling operation of the determined number of the electric motors, wherein motor controller simultaneously operates the determined number of electric motors to drive the hydraulic pump.

2. The system according to claim 1, wherein the steering load determining device comprises;

a driven stroke detector for detecting a driven stroke per unit time of the hydraulic actuator; and a steering load calculator for calculating the steering load based on the detected driven stroke per unit time of the hydraulic actuator.

3. The system according to claim 1, wherein the motors are sized such that an output from each of the motors individually is insufficient to drive the hydraulic pump when a large steering load is determined.

4. A steering system for steering an outboard motor, mounted on a stern of a boat through stern brackets, relative to the boat, said steering system comprising:

a first hydraulic actuator for adjusting a steering angle of the outboard motor relative to the boat;

a first hydraulic fluid supply source for supplying hydraulic fluid to the first hydraulic actuator;

a second hydraulic actuator for regulating a tilt/trim angle of the outboard motor relative to the boat;

a second hydraulic fluid supply source for supplying the hydraulic fluid to the second hydraulic actuator; and a fluid diverter for diverting at least a part of the hydraulic fluid to be supplied to one of the first and second hydraulic actuators, to the other of the first and second hydraulic actuators, wherein the fluid diverter includes:

a first fluid path connecting the first fluid supply source to the first hydraulic actuator;

a second fluid path connecting the second fluid supply source to the second hydraulic actuator;

a third fluid path connecting the first fluid path to the second fluid path;

a first flow dividing valve comprising a first metering valve disposed in the third fluid path and a second metering valve disposed in the second fluid path at a location downstream of the third fluid path; and a second flow dividing valve comprising a third metering valve disposed in the third fluid path and a fourth metering valve disposed in the first fluid path at a location downstream of the third fluid path.

5. The system according to claim 4, wherein the fluid diverter includes:

a selector lever for allowing destination of supply of the hydraulic fluid to be diverted.

6. The system according to claim 4, further including:

a plurality of sensors for detecting state of operation of the outboard motor;

an electromagnetic solenoid allowing destination of supply of the hydraulic fluid to be diverted; and a control unit controlling to energize/deenergize the solenoid based on the detected state of operation of the outboard motor.

* * * * *